US007914112B2

(12) United States Patent
Hayashi et al.

(10) Patent No.: US 7,914,112 B2
(45) Date of Patent: Mar. 29, 2011

(54) PRINTING APPARATUS WITH SWITCHOVER SECTION THAT SWITCHES OVER PATTERNS OF VELOCITY DATA

(75) Inventors: Toru Hayashi, Shiojiri (JP); Tetsuji Takeishi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 707 days.

(21) Appl. No.: 11/900,473

(22) Filed: Sep. 12, 2007

(65) Prior Publication Data

US 2008/0063455 A1 Mar. 13, 2008

(30) Foreign Application Priority Data

Sep. 12, 2006 (JP) ..... 2006-246390

(51) Int. Cl.
*B41J 19/18* (2006.01)
*B41J 29/38* (2006.01)
*B41J 2/01* (2006.01)

(52) U.S. Cl. ..... 347/39; 347/37; 400/283; 400/319; 400/322; 400/323

(58) Field of Classification Search ..... None
See application file for complete search history.

(56) References Cited

U.S. PATENT DOCUMENTS 5,189,436 A 2/1993 Yoshikawa
5,527,121 A * 6/1996 Santon ..... 400/323
2003/0164867 A1* 9/2003 Herwald et al. ..... 347/37
2004/0008244 A1* 1/2004 Tsujimoto ..... 347/105
2007/0040861 A1* 2/2007 Toh et al. ..... 347/19

FOREIGN PATENT DOCUMENTS

| | | | |
|---|---|---|---|
| JP | 3-218881 | | 9/1991 |
| JP | 05-038861 | | 2/1993 |
| JP | 11-320854 | | 11/1999 |
| JP | 2000318216 | A * | 11/2000 |
| JP | 2002-019100 | | 1/2002 |
| JP | 2002-356003 | | 12/2002 |
| JP | 2004-322463 | | 11/2004 |
| JP | 2005262773 | A * | 9/2005 |
| JP | 2006-168108 | | 6/2006 |

* cited by examiner

*Primary Examiner* — Daniel J Colilla
(74) *Attorney, Agent, or Firm* — Nutter McClennen & Fish LLP; John J. Penny, Jr.; Michael P. Visconti, III

(57) ABSTRACT

The invention relates to a printing apparatus that performs printing by scanning a carriage that has a print head in a main scan direction. The printing apparatus according to an aspect of the present invention includes: a carriage motor that drives the carriage; a control unit that controls the driving of the carriage motor; a memory unit that stores a plurality of patterns of velocity data regarding at least either one of scanning speeds of the carriage after start of the scanning and driving speeds of the carriage motor corresponding to the scanning speeds of the carriage; and a driving mode switchover unit that switches over the patterns of the velocity data, wherein the control unit controls the driving of the carriage motor in such a manner that the carriage is scanned on the basis of the velocity data selected by the driving mode switchover unit.

6 Claims, 16 Drawing Sheets

PRINTING APPARATUS WITH SWITCHOVER SECTION THAT SWITCHES OVER PATTERNS OF VELOCITY DATA

BACKGROUND

1. Technical Field

The present invention relates to a printing apparatus.

2. Related Art

A dot impact printer is known as one example of various kinds of conventional printing apparatuses. As disclosed in JP-A-2004-322463, a dot impact printer prints images by striking a number of recording wires onto a sheet of print target medium so as to record dot pattern thereon while scanning (i.e., moving) a carriage, which has recording heads mounted thereon, in the axial direction of a carriage axis.

The dot impact printer described in JP-A-2004-322463 (refer to abstract thereof) changes the accelerated velocity of the carriage during acceleration and deceleration thereof depending on the characteristic value of its operating environment. That is, in accordance with the environmental characteristic value, the disclosed dot impact printer changes the accelerated velocity of the carriage that is applied during acceleration up to the point at which the moving speed of the carriage reaches a predetermined value and the accelerated velocity thereof that is applied during deceleration from the point at which the carriage moves at the predetermined speed till it stops. By this means, the related-art dot impact printer described in the above publication achieves high-precision printing depending on use environment.

As described above, the related-art dot impact printer disclosed in the above publication changes the accelerated velocity of the carriage during acceleration and deceleration thereof depending on the characteristic value of its operating environment. Therefore, under a given set of circumstances, the carriage moves in a main scan direction constantly with the same accelerated velocity. For this reason, disadvantageously, the carriage is susceptible to intense vibration always at the same time after the start of its scanning movement, that is, when the forced vibration frequency of a carriage driving motor coincides with the resonance frequency of the dot impact printer. It is desired to provide a technical solution to the problem of uneven printing, which could occur when the carriage is vibrated intensely during the execution of printing. One conceivable solution for prevention of uneven printing is, for example, to accelerate and decelerate the carriage in a "no-ink-discharge" state. However, if such an approach is taken, a sufficiently wide space is required to secure the scanning range of the carriage.

SUMMARY

An advantage of some aspects of the invention is to provide a printing apparatus that does not form "rainbow unevenness" in a print target medium.

In order to address the above-identified problems without any limitation thereto, the invention provides, as a first aspect thereof, a printing apparatus that performs printing by scanning a carriage that has a print head in a main scan direction, the printing apparatus including: a carriage motor that drives the carriage; a control section that controls the driving of the carriage motor; a memory section that stores a plurality of patterns of velocity data regarding at least either one of scanning speeds of the carriage after start of the scanning and driving speeds of the carriage motor corresponding to the scanning speeds of the carriage; and a driving mode switchover section that switches over the patterns of the velocity data, wherein the control section controls the driving of the carriage motor in such a manner that the carriage is scanned on the basis of the velocity data selected by the driving mode switchover section.

With such a configuration, since the carriage is scanned on the basis of velocity data selected, as a result of switchover, by the driving mode switchover section, it is possible to switch over to velocity data that is suited for the operating environment or the like among the plurality of patterns of velocity data. Therefore, the invention makes it possible to respond flexibly to the operating environment, which achieves printing with high precision. In addition thereto, the above-mentioned switchover makes it possible to stagger points in time at which the carriage is affected by vibrations. Therefore, it is possible to spread uneven printing points caused by the vibrations of the carriage. Thus, the invention makes it possible to effectively avoid the generation of rainbow unevenness on the print target medium after completion of printing.

In the configuration of the printing apparatus according to the first aspect of the invention, it is preferable that the plurality of patterns of the velocity data are provided for at least either one of acceleration and deceleration of the carriage that is to be scanned.

According to the above configuration, the velocity data have a plurality of acceleration inclinations or a plurality of deceleration inclinations. Therefore, the above-mentioned switchover performed by the driving mode switchover section makes it possible to stagger points in time at which the carriage is affected by vibrations during at least either one of acceleration and deceleration of the carriage.

In the configuration of the printing apparatus according to the first aspect of the invention, it is preferable that the driving mode switchover section switches over the plurality of patterns of the velocity data stored in the memory section so as to select a pattern of the velocity data to be used in a sequential manner among the plurality of patterns of the velocity data.

With such a configuration, the carriage is scanned in accordance with the velocity data having patterns different from one another that are switched therebetween in a sequential manner. Therefore, the above-mentioned switchover makes it possible to stagger points in time at which the carriage is affected by vibrations without fault. Therefore, it is possible to spread uneven printing points caused by the vibrations of the carriage without fault. Thus, the invention makes it possible to effectively avoid the generation of rainbow unevenness on the print target medium after completion of printing.

In the configuration of the printing apparatus according to the first aspect of the invention, it is preferable that the driving mode switchover section switches over the patterns of the velocity data either for each outward movement or for each set of outward and homeward movements of the carriage.

With such a configuration, it is possible to perform the switchover of the scanning speeds of the carriage both for bidirectional printing and unidirectional printing. Therefore, the above-mentioned switchover makes it possible to stagger points in time at which the carriage is affected by vibrations for each scanning.

In the configuration of the printing apparatus according to the first aspect of the invention, it is preferable that the printing apparatus further includes a print target medium recognition section that detects the size or the type of a print target medium, wherein the driving mode switchover section switches over the patterns of the velocity data on the basis of a result of detection that is performed by the print target medium recognition section.

With such a configuration, it is possible to scan the carriage at the scanning speed suited for the size or the type of the print target medium.

In the configuration of the printing apparatus according to the first aspect of the invention, it is preferable that the driving mode switchover section switches over the patterns of the velocity data on the basis of ink discharge amount.

With such a configuration, it is possible to scan the carriage on the basis of a predetermined velocity data depending on required printing precision.

In order to address the above-identified problems without any limitation thereto, the invention provides, as a second aspect thereof, a printing apparatus that performs printing by scanning a carriage that has a print head in a main scan direction, the printing apparatus including: a carriage motor that drives the carriage; a control section that controls the driving of the carriage motor; a memory section that stores a plurality of pieces of data regarding at least either one of movement start positions of the carriage and movement stop positions of the carriage; and a movement position switchover section that switches over at least either one of the movement start positions of the carriage and the movement stop positions of the carriage, wherein the control section controls the driving of the carriage motor in such a manner that the carriage is scanned on the basis of the movement start position and/or the movement stop position selected by the movement position switchover section.

With such a configuration, since the carriage is scanned on the basis of movement start positions and movement stop positions selected, as a result of switchover, by the movement position switchover section, it is possible to switch over to a movement start position and a movement stop position that is suited for the operating environment or the like among the plurality of movement start positions and movement stop positions. Therefore, the invention makes it possible to respond flexibly to the operating environment, which achieves printing with high precision. In addition thereto, the above-mentioned switchover makes it possible to stagger points in time at which the carriage is affected by vibrations. Therefore, it is possible to spread uneven printing points caused by the vibrations of the carriage. Thus, the invention makes it possible to effectively avoid the generation of rainbow unevenness on the print target medium after completion of printing.

In the configuration of the printing apparatus according to the second aspect of the invention, it is preferable that the movement position switchover section switches over at least either one of the movement start positions and the movement stop positions either for each outward movement or for each set of outward and homeward movements of the carriage.

With such a configuration, it is possible to perform the switchover of at least either one of the movement start positions and the movement stop positions of the carriage both for bidirectional printing and unidirectional printing. Therefore, the above-mentioned switchover makes it possible to stagger points in time at which the carriage is affected by vibrations for each scanning.

In the configuration of the printing apparatus according to the second aspect of the invention, it is preferable that the printing apparatus further includes a print target medium recognition section that detects the size or the type of a print target medium, wherein the movement position switchover section switches over at least either one of the movement start positions and the movement stop positions on the basis of a result of detection that is performed by the print target medium recognition section.

With such a configuration, it is possible to scan the carriage at the movement start position and/or the movement stop position suited for the size or the type of the print target medium.

In the configuration of the printing apparatus according to the second aspect of the invention, it is preferable that the movement position switchover section switches over at least either one of the movement start positions and the movement stop positions on the basis of ink discharge amount.

With such a configuration, it is possible to scan the carriage on the basis of a predetermined movement start position and/or movement stop position depending on required printing precision.

In the configuration of the printing apparatus according to the second aspect of the invention, it is preferable that printing is started during acceleration of the carriage, or the started printing is continued until the carriage decelerates.

With such a configuration, it is possible to provide a "marginless" printing, that is, printing with no margin left at edges of the printing paper, or printing with relatively narrow margins left thereat. Thus, the invention makes it possible to offer high-quality printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

With reference to accompanying drawings, a printing apparatus 1 according to a first exemplary embodiment of the invention is described below.

Figure 1:
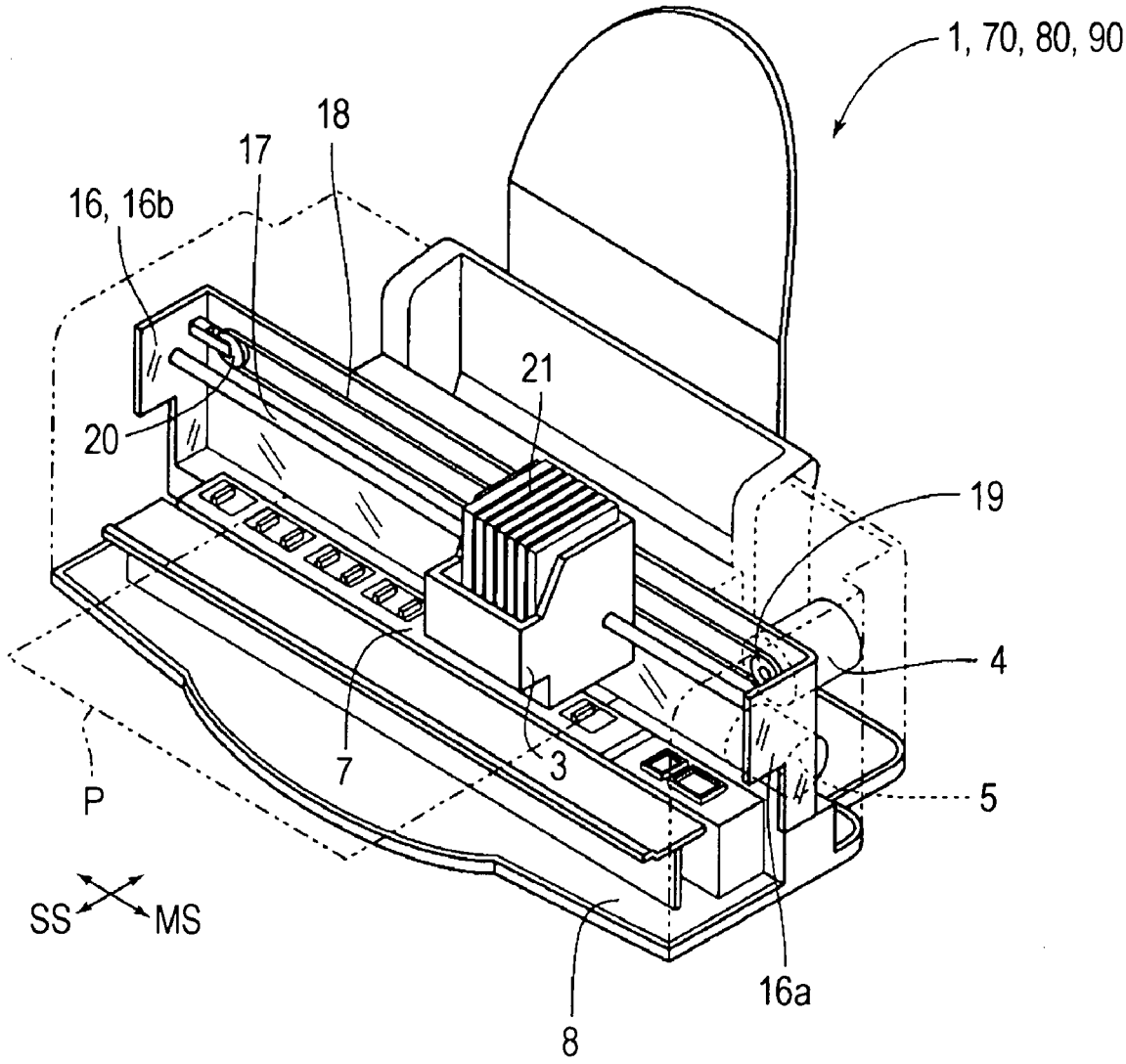
FIG. 1 is a perspective view that schematically illustrates an example of the overall configuration of a printing apparatus according to a first exemplary embodiment of the invention.
Figure 2:
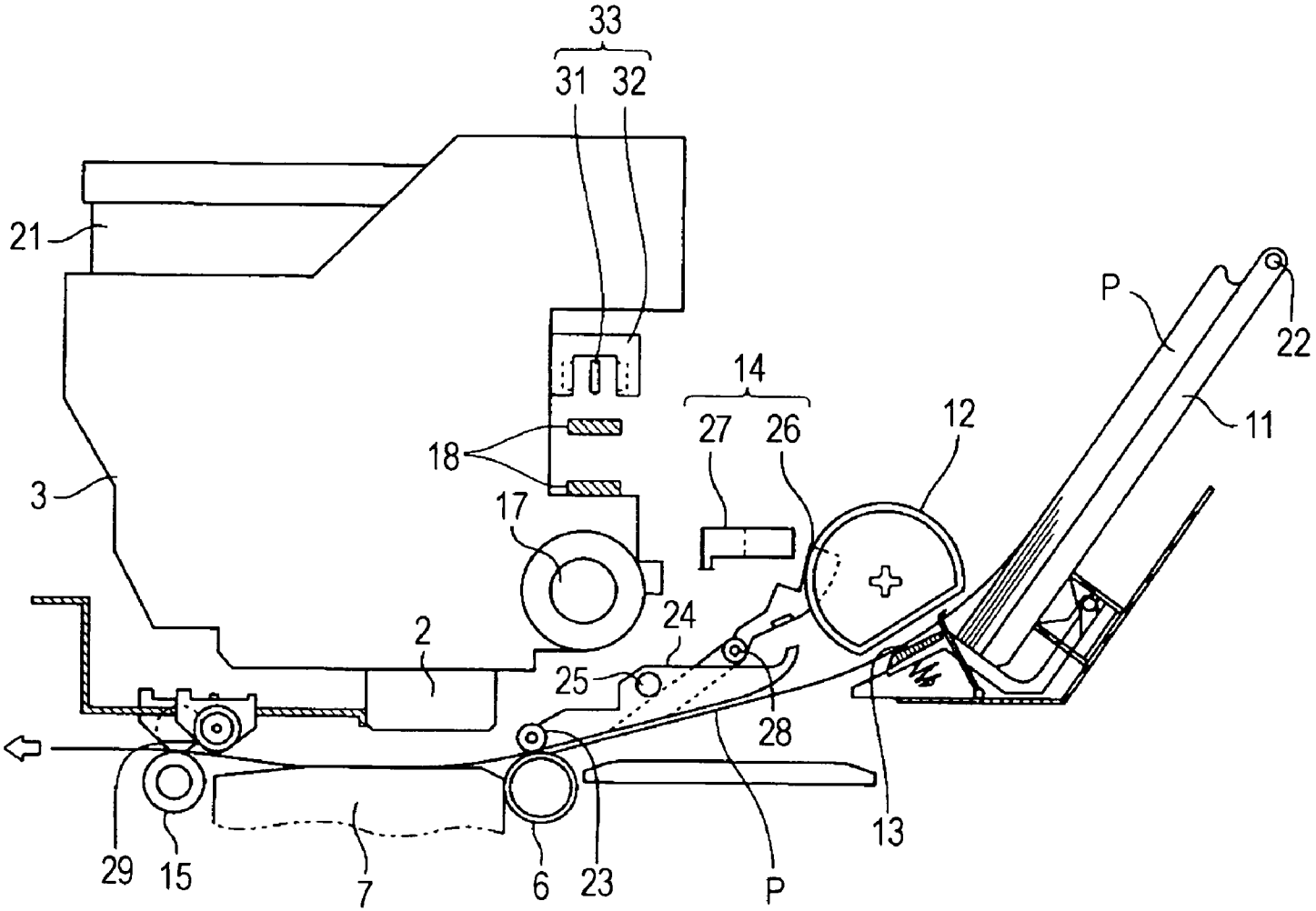
FIG. 2 is a side view that schematically illustrates an example of the partial configuration of the printing apparatus illustrated in FIG. 1, focusing on the paper feeding structure thereof.
Figure 3:
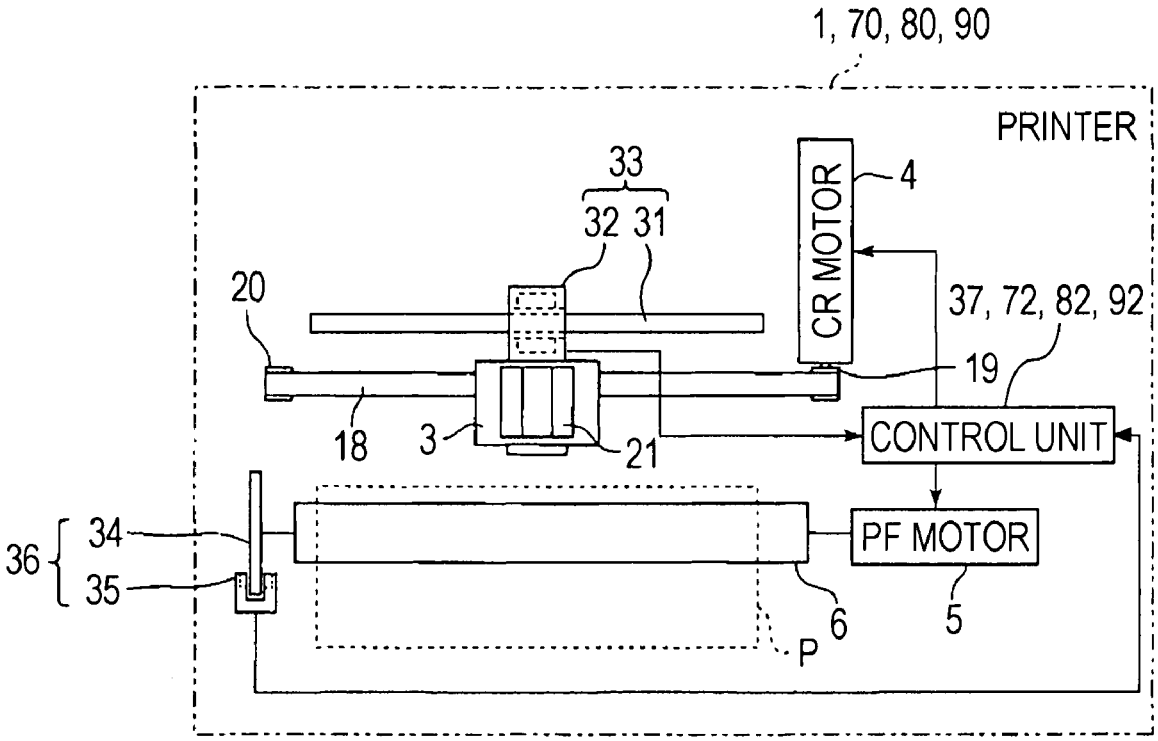
FIG. 3 is a diagram that schematically illustrates an example of the control mechanism of the printing apparatus illustrated in FIG. 1.

FIG. 1 is a perspective view that schematically illustrates an example of the overall configuration of a printing apparatus 1 according to the first exemplary embodiment of the invention. FIG. 2 is a side view that schematically illustrates an example of the partial configuration of the printing apparatus 1 illustrated in FIG. 1, focusing on the paper feeding structure thereof. FIG. 3 is a diagram that schematically illustrates an example of the control mechanism of the printing apparatus 1 illustrated in FIG. 1.

The printing apparatus 1 according to the present embodiment of the invention is configured as an ink-jet printer. An ink-jet printer performs printing by discharging ink in the form of a liquid onto a sheet of printing paper P that is taken as an example of various kinds of recording target media herein. In the following description, the printing apparatus according to the present embodiment of the invention is simply referred to as printer. As illustrated in FIGS. 1 and 2, a printer 1 according to the present embodiment of the invention is provided with a carriage 3, a carriage motor (CR motor) 4, a paper feed motor (PF motor) 5, a PF driving roller 6, a platen 7, and a printer body chassis 8. A print head 2, which discharges ink drops, is mounted on the carriage 3. The CR motor 4 drives the carriage 3 so that it moves in the main scan (MS) direction. The PF motor 5 provides a driving force for transportation of the printing paper P in the sub scan (SS) direction. The PF driving roller 6 is interlocked with the PF motor 5. The platen 7 is arranged so as to be opposed to the nozzle surface of the print head 2 (i.e., the lower surface thereof according to FIG. 2). These components are housed in the printer body chassis 8. In the present embodiment of the invention, both of the CR motor 4 and the PF motor 5 are configured as direct-current (DC) motors.

As illustrated in FIG. 2, the printer 1 is further provided with a hopper (feeder) 11, a paper feed roller 12, a detachment pad 13, a paper detector 14, and a paper ejection drive roller 15. The printing papers P that are waiting to be print-processed are placed on the hopper 11. The paper feed roller 12 and the detachment pad 13 work in combination with each other so as to take the printing paper P placed on the hopper 11 into the printer 1. The paper detector 14 detects the printing paper P that is taken from the hopper 11 into the printer 1 as it passes through a detection area thereof. The paper ejection drive roller 15 ejects the printed paper P (i.e., printing paper P after completion of printing) out of the printer 1.

In the configuration of the printer 1, the carriage 3 has its home position at the right end of its scanning range according to FIG. 1 (i.e., near end according to FIG. 2). Accordingly, the carriage 3 has its "away" position at the other end opposite to the home position end (i.e., left end according to FIG. 1, and far end according to FIG. 2). The carriage 3 moves within the scanning range, which is defined as a region from the home position to the away position.

The carriage 3 is configured so that it can travel in the main scan MS direction along a guide shaft 17, which is supported by a supporting frame 16 that is fixed to the printer body chassis 8, by means of a timing belt 18. As illustrated in FIG. 2, the timing belt 18, a part of which is fixed to the carriage 3, is wound around pulleys 19 and 20 in such a manner that it has a certain belt tension therebetween. The pulley 19 is attached to the output axis of the CR motor 4, whereas the pulley 20 is attached to the supporting frame 16 in a rotatable manner. The guide shaft 17 supports and guides the carriage 3 in such a manner that it can slide thereon in the MS direction. In addition to the print head 2, ink cartridges 21 are detachably attached to the carriage 3. The ink cartridges 21 contain various kinds of ink to be supplied to the print head 2.

The paper feed roller 12 is coupled to the PF motor 5 by means of interlocking gears that are not shown in the drawing. Accordingly, the PF motor 5 drives the paper feed roller 12 by communicating its driving force through the interlocking gears. As illustrated in FIG. 2, the hopper 11 is configured as a plate member on which the printing papers P can be placed. By means of a cam mechanism that is not shown in the drawing, the hopper 11 can oscillate around a turn axis 22 that is provided at the upper portion thereof. As the hopper 11 shakes through the working of the cam mechanism, the lower end of the hopper 11 is pressed resiliently against the paper feed roller 12 at one time and moves away from the paper feed roller 12 at another time. The detachment pad 13 is provided at a position opposed to the paper feed roller 12. As the paper feed roller 12 rotates, the surface of the paper feed roller 12 contacts the detachment pad 13. With such a structure, when the paper feed roller 12 rotates, the uppermost one of the printing papers P placed on the hopper 11 passes through the contact region between the surface of the paper feed roller 12 and the detachment pad 13 to be fed toward the paper-ejection side of the printer 1. In contrast, the second printing paper P counted from the top and the remaining sheets of the printing papers P thereunder placed on the hopper 11 are prevented from being transported toward the paper-ejection side thereof thanks to the functioning of the detachment pad 13.

The PF driving roller 6 is coupled to the PF motor 5 either directly or by means of interlocking gears that are not shown in the drawing. As illustrated in FIG. 2, the printer 1 has a PF slave roller (i.e., driven roller) 23 that cooperates with the PF driving roller 6 so as to transport the printing paper P. The PF slave roller 23 is provided at the paper-ejection side of a slave roller holder (i.e., driven roller holder) 24 in a rotatable manner. The slave roller holder 24 is configured in such a manner that it can oscillate (i.e., turn) around a turn axis 25. The slave roller holder 24 is urged counter clockwise in FIG. 2 by a spring that is not shown in the drawing in such a manner that the PF slave roller 23 is constantly urged toward the PF driving roller 6. With such a structure, when the PF driving roller 6 is driven, the PF slave roller 23 turns as the PF driving roller 6 turns.

As illustrated in FIG. 2, the paper detector 14, which is made up of a detection lever 26 and a paper detection sensor 27, is provided in the proximity of the slave roller holder 24. The detection lever 26 can oscillate around a turn axis 28. When the printing paper P transitions from a "paper-passing" state illustrated in FIG. 2 to a next state, that is, after the printing paper P has passed through a region under the detection lever 26, the detection lever 26 turns counterclockwise. As the detection lever 26 turns, light propagating from the light emission portion of the paper detection sensor 27 toward the light reception portion thereof is shut off. By this means, the paper detector 14 is able to detect the passing of the printing paper P.

The paper ejection drive roller 15, which is provided at the paper-ejection side of the printer 1, is coupled to the PF motor 5 by means of interlocking gears that are not shown in the drawing. As illustrated in FIG. 2, the printer 1 has a paper ejection slave roller 29 that cooperates with the paper ejection drive roller 15 so as to eject the printing paper P. In the same way as the PF slave roller 23 is done, the paper ejection slave roller 29 is urged by a spring that is not shown in the drawing in such a manner that it is constantly urged toward the paper ejection drive roller 15. With such a structure, when the paper ejection drive roller 15 is driven, the paper ejection slave roller 29 turns as the paper ejection drive roller 15 turns.

As illustrated in FIGS. 2 and 3, the printer 1 is provided with a linear encoder 33, which is made up of a linear scale 31 and a photo sensor 32, as a positional detection device that detects the position of the carriage 3 in the MS direction. The linear encoder 33 further detects the moving speed of the carriage 3 in the MS direction and/or similar parameters thereof. In addition, as illustrated in FIG. 3, the printer 1 is further provided with a rotary encoder 36, which is made up of a rotary scale 34 and a photo sensor 35, as another positional detection device that detects the position of the printing paper P in the SS direction. The rotary encoder 36 further detects the transportation speed of the printing paper P in the SS direction and/or similar parameters thereof. Specifically, the rotary encoder 36 detects the rotation position, the rotation speed, and the like, of the PF driving roller 6. Signals outputted from the linear encoder 33 and the rotary encoder 36 are, as illustrated in FIG. 3, inputted into a control unit 37, which functions as a control section (as recited in the appended claims), so that the control unit 37 can perform various kinds of control on the printer 1.

In the printer 1 configured as described above, the printing paper P, which has been taken from the hopper 11 into the printer 1 by means of the paper feed roller 12 and the detachment pad 13, is transported in the SS direction by the PF driving roller 6, which is driven and turned by the PF motor 5. While the printing paper P is being fed in the SS direction, the carriage 3, which is driven by the CR motor 4, reciprocates (i.e., moves in a reciprocatory manner) in the MS direction. When the carriage 3 reciprocates, ink drops are discharged from the print head 2. By this means, printing is performed on the printing paper P. For the purpose of shortening the distance in the MS direction of the printer 1 so as to achieve a smaller body configuration thereof, the discharge of ink drops from the print head 2 is started during the acceleration of the carriage 3, whereas the discharge of ink drops from the print head 2 is finished during the deceleration thereof. After print processing on the printing paper P is completed, the printing paper P is ejected out of the printer 1 by means of the paper ejection drive roller 15 and the paper ejection slave roller 29.

The printer 1 has its inherent (i.e., natural) resonance frequency. When the resonance frequency of the printer 1 coincides with the forced vibration frequency of the CR motor 4, which drives the carriage 3, the printer 1 vibrates in resonance therewith. When the resonance vibration is generated, the vibration is communicated to the carriage 3, which causes uneven printing. In order to avoid such a problem, it is necessary to control the driving speed of the CR motor 4 so that the resonance vibration does not occur in the printer 1. In the present embodiment of the invention, it is assumed that the resonance vibration is generated when the scanning speed of the carriage 3 reaches 22 ips. It should be noted that the above scanning speed of the carriage 3 that causes the resonance vibration, that is, 22 ips, according to the present embodiment of the invention is nothing more than an example given solely for the purpose of illustrative explanation. In actual implementation of the invention, the scanning speed thereof could vary depending on the type, size, and/or similar factors of a printer. It should be further noted that, when the forced vibration frequency of the CR motor 4 reaches two resonance frequencies of the printer 1, that is, the secondary resonance frequency and the tertiary resonance frequency thereof, the printer 1 vibrates in resonance therewith twice each at the time of acceleration of the carriage 3 and at the time of deceleration thereof.

Figure 4:
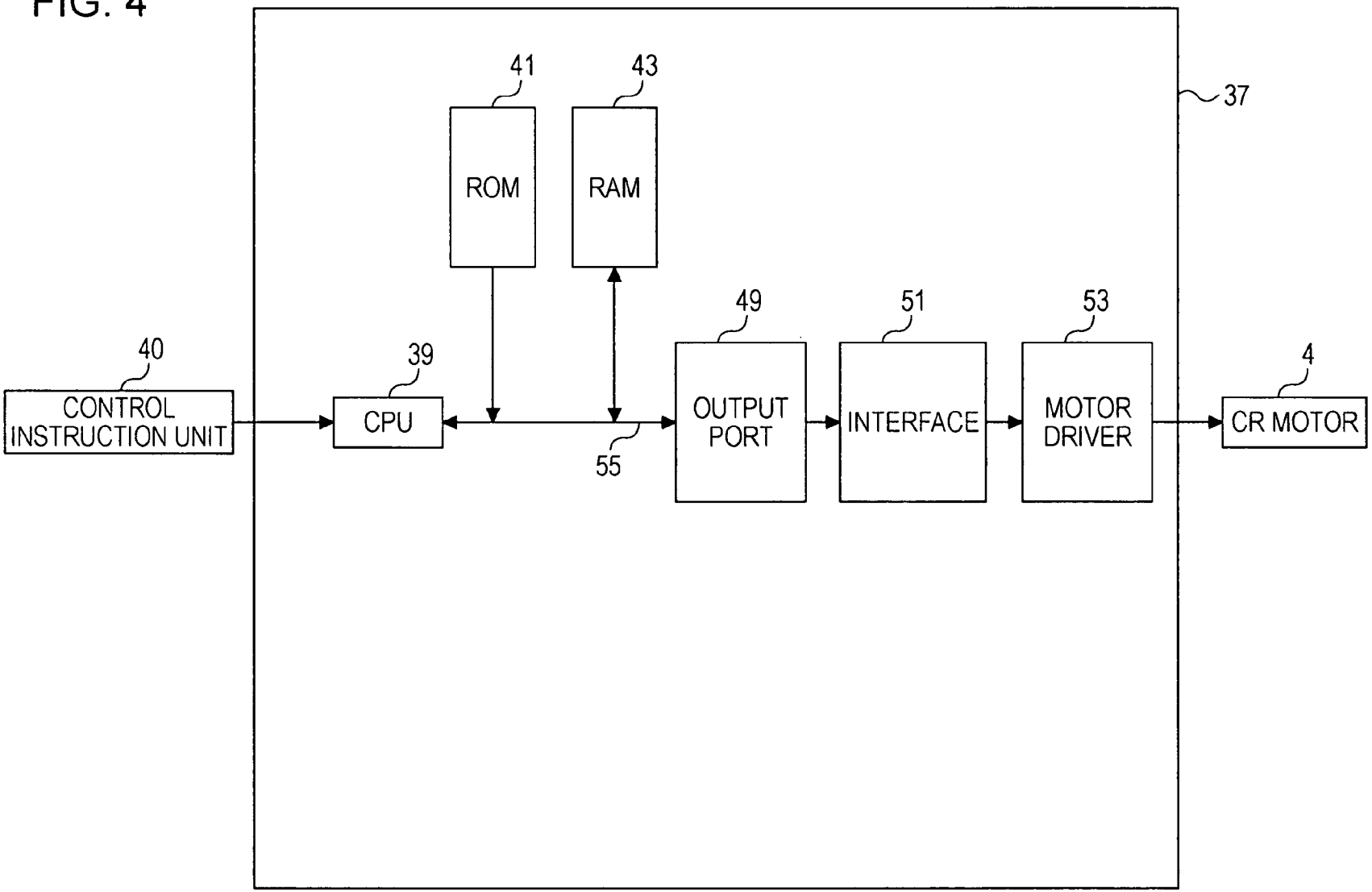
FIG. 4 is a block diagram that schematically illustrates an example of the configuration of a control unit according to the first exemplary embodiment of the invention.
Figure 5A:
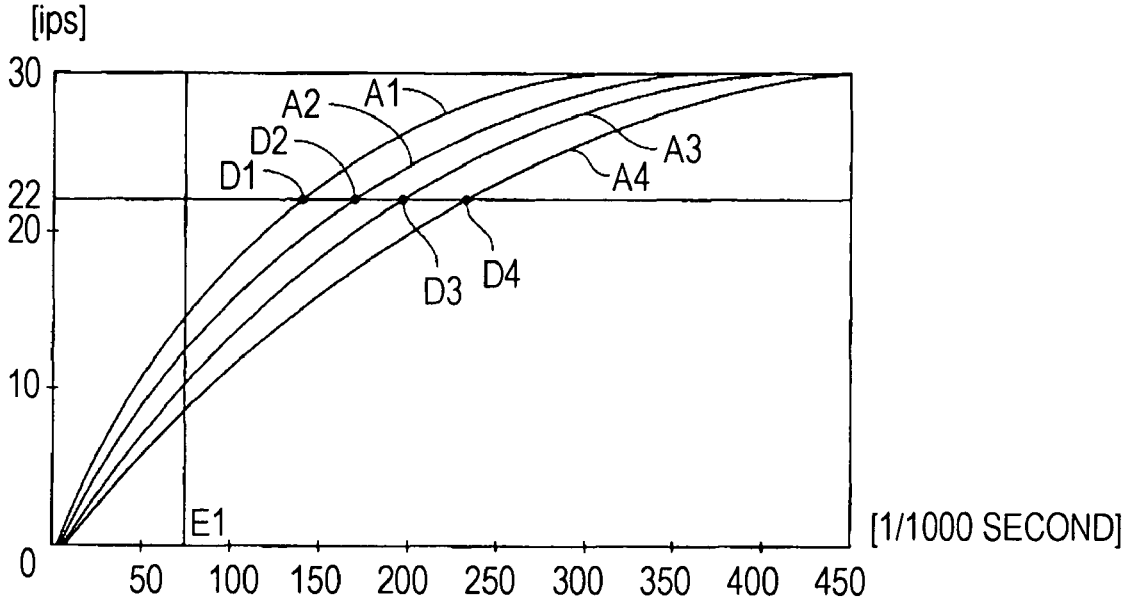
FIG. 5 is a set of diagrams that illustrates the scanning speeds of a carriage that correspond to a plurality of velocity curves switched over therebetween.
Figure 5B:
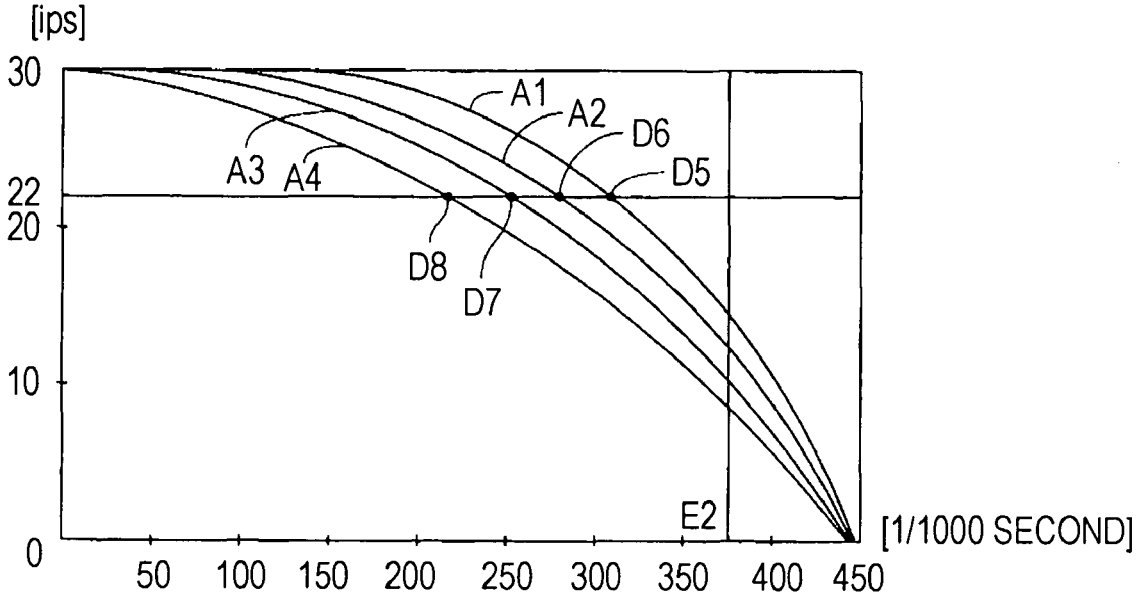

FIG. 4 is a block diagram that schematically illustrates an example of the configuration of the control unit 37, which controls the CR motor 4 illustrated in FIG. 1. FIG. 5 is a set of diagrams that illustrates velocity curves in the scanning of the carriage 3. Specifically, FIG. 5A illustrates the velocity curves that apply during acceleration of the carriage 3. On the other hand, FIG. 5B illustrates the velocity curves that apply during deceleration thereof. In each of FIGS. 5A and 5B, the horizontal axis represents time where the driving start of the carriage 3 is taken as zero. The vertical axis in each of FIGS. 5A and 5B represents the scanning speed of the carriage 3.

As has already been described, the control unit 37 functions to perform various kinds of control on the printer 1. As one of its functions, the control unit 37 controls the CR motor 4 as illustrated in FIG. 3. Various kinds of signals are inputted into the control unit 37, including, though not limited thereto, signals coming from various kinds of sensors such as the paper detection sensor 27, the linear encoder 33, the rotary encoder 36, etc., and a power signal coming from a power switch, which turns the power of the printer 1 ON/OFF. In addition, printing signals are inputted from a control instruction unit 40 of an external device such as a computer or the like that is connected to the printer 1 so as to specify various kinds of printing parameters such as paper size, paper type, resolution, MicroWeave, bidirectional printing, color adjustment, and so on.

In the present embodiment of the invention, when the carriage 3 is moved in the MS direction, the control unit 37 controls the accelerated velocity of the carriage 3 that is applied during acceleration up to the point at which the moving speed of the carriage 3 reaches a predetermined value (hereafter referred to as "steady-state velocity") and the accelerated velocity thereof that is applied during deceleration from the point at which the carriage 3 moves at the steady-state velocity till it stops. That is, the control unit 37 controls the driving speed of the CR motor 4 during acceleration and deceleration of the carriage 3.

As illustrated in FIG. 4, the control unit 37 is provided with a CPU 39, a ROM 41, a RAM 43, an output port 49, an interface 51, and a motor driver 53. These components are interconnected with one another via a bus 55, which is a group of signal lines.

The CPU 39 functions as the central unit that handles data computation/processing among these components. Specifically, the CPU 39 executes programs that are stored in the ROM 41, which serves as a memory section (as recited in the appended claims), and stored in the RAM 43, which serves as another memory section. In addition, the CPU 39 receives data from an input unit (i.e., input means), the ROM 41, and the RAM 43 to perform computation on the basis of the received data and processes the received data. Then, the CPU 39 outputs the computed/processed data to the motor driver 53 via the interface 51, which is an output unit (i.e., output means). The CPU 39 receives the above-described signals coming from various kinds of sensors such as the paper detection sensor 27, the linear encoder 33, the rotary encoder 36, etc., the power signal coming from the power switch, which turns the power of the printer 1 ON/OFF, and/or the printing signal supplied from the control instruction unit 40. The CPU 39 functions as a driving mode switchover section (as recited in the appended claims) that switches over velocity data patterns in accordance with velocity curves A1-A4 stored in the ROM 41. The CR motor 4 is driven on the basis of the velocity data that is selected (i.e., switched over) by the CPU 39 so as to move the carriage 3.

The ROM 41 memorizes control programs that are used for controlling the printer 1 and other data that are required for print processing. In the present embodiment of the invention, specifically, the ROM 41 memorizes control programs that are used for acceleration/deceleration control. In addition to such acceleration/deceleration control programs, data pertaining to the driving speed of the CR motor 4 that correspond to the plurality of acceleration curves A1-A4 illustrated in FIG. 5A and the plurality of deceleration curves A1-A4 illustrated in FIG. 5B (i.e., velocity data corresponding to time) are stored in the ROM 41. Each of the deceleration curves A1-A4 constitutes a "mirror-pattern" curve of the corresponding one of the acceleration curves A1-A4. When both of the acceleration curves A1-A4 and the deceleration curves A1-A4 are used in accordance with the selection (i.e., switchover) done by the CPU 39, each of the acceleration curves A1-A4 and the corresponding one of the deceleration curves A1-A4 are used as a pair. In the following description, when each of the acceleration curves A1-A4 and the corresponding one of the deceleration curves A1-A4 are used as a pair, it is simply referred to as a velocity curve A1-A4. The RAM 43 serves as a temporary memory in which programs, data, and the like that are required for the CPU 39 to perform print execution and print computation are stored.

The output port 49 takes out necessary data only in a selective manner from the CPU 39, the RAM 43, etc., and supplies the extracted data to the interface 51. The interface 51 is responsible for ensuring various kinds of electric and temporal (i.e., timing) matching. Specifically, for example, the interface 51 performs signal level conversion on a signal that is inputted from the output port 49. In addition, the interface 51 performs data interface timing control. On the basis of an input signal supplied from the interface 51, the motor driver 53 supplies a current to each phase of the CR motor 4 so as to drive the CR motor 4 for rotation thereof.

The driving speed of the CR motor 4 is controlled on the basis of various kinds of signals that are inputted from the control instruction unit 40 and/or on the basis of the result of computation performed by the CPU 39. Specifically, the CPU 39 performs arithmetic processing on the basis of the velocity data and/or the programs stored in the ROM 41 or the RAM 43. The result of the computation thereof is inputted into the motor driver 53 via the output port 49 and the interface 51. Then, the motor driver 53 supplies the driving power to the CR motor 4. In addition to the above, the driving speed of the CR motor 4 is also controlled on the basis of printing signals that are inputted from the control instruction unit 40, which specify various kinds of printing parameters such as paper size, paper type, resolution, printing mode, bidirectional printing, color adjustment, and so on. It should be noted that such printing parameters including but not limited to paper size, paper type, resolution, printing mode, (unidirectional printing or) bidirectional printing, and color adjustment may be arbitrarily set depending on the operating environment of the printer 1.

Next, a printing operation that is performed when the CPU 39 switches driving modes is explained below.

Figure 6:
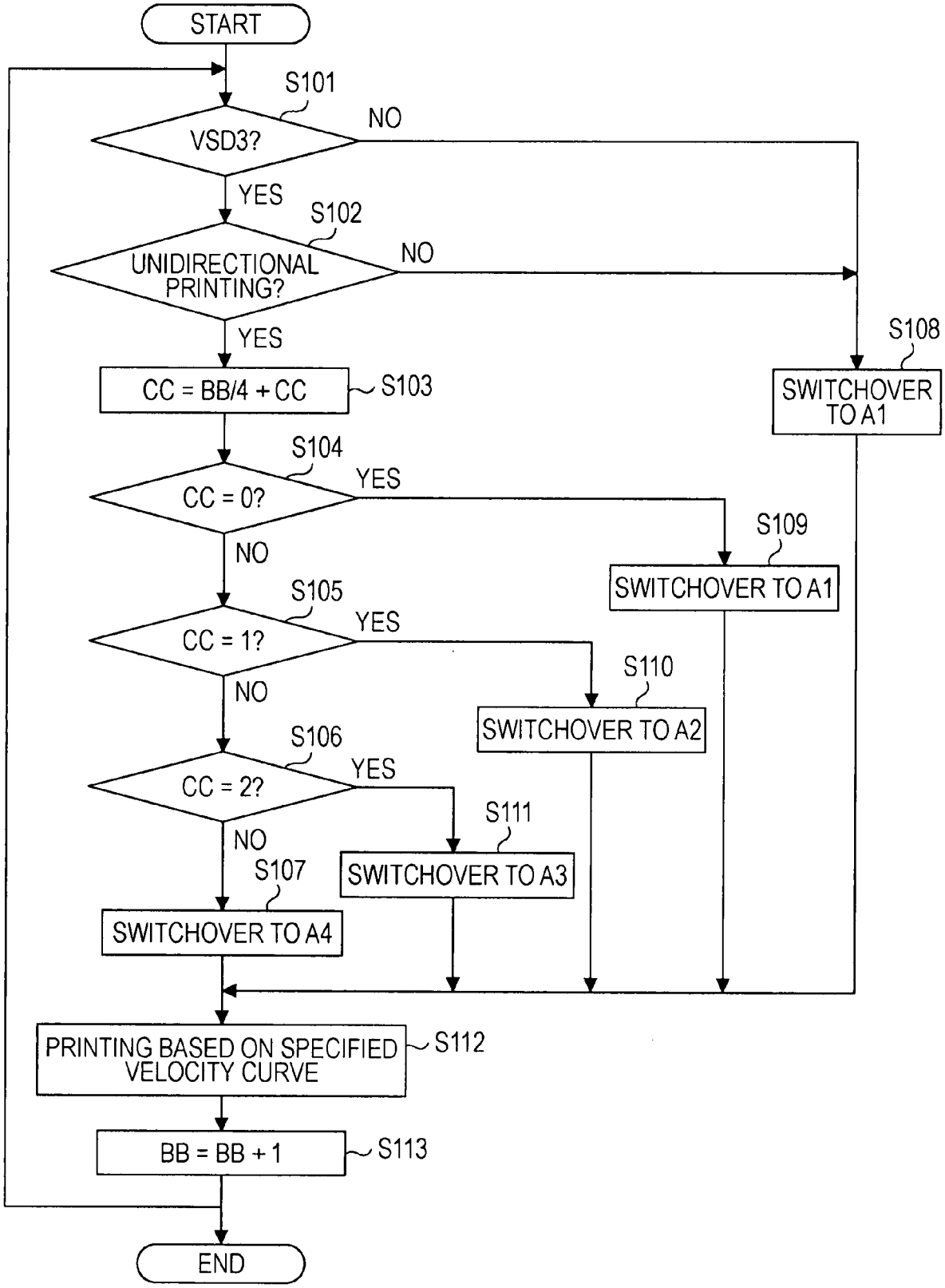
FIG. 6 is a flowchart that illustrates the operational flow of switchover processing performed by a driving mode switchover section.

FIG. 6 is a flowchart that illustrates the operational flow of mode switchover processing, which is performed by the CPU 39 (driving mode switchover section). FIG. 7 is a set of explanatory diagrams that illustrates the comparative print results that appear on the printed paper P so as to show a distinctive advantage that is gained when the CPU 39 switches driving modes according to the invention.

When printing is performed, as the first step, the control instruction unit 40 receives print-related data such as paper size, paper type, resolution, printing mode, unidirectional printing or bidirectional printing, color adjustment, and so on. Upon reception of these data, the control instruction unit 40 supplies a signal based on the received data to the CPU 39. As the next step, the CPU 39 reads out velocity data stored in the ROM 41 or the RAM 43 on the basis of the input signal supplied from the control instruction unit 40. In the present embodiment of the invention, it is assumed that printing is performed under a MicroWeave printing mode. Herein, the term "MicroWeave" refers to a printing function/method where a print head having a plurality of nozzles is used to scan the same single line by means of different nozzles so as to form each one dot in a superposed manner. The MicroWeave printing ensures high quality in printed images.

In the present embodiment of the invention, it is assumed that so-called unidirectional printing is performed. In the unidirectional printing, ink drops are discharged from the print head 2 onto the printing paper P during a time period in which the carriage 3 travels along the MS direction from the home position to the away position thereof, which is referred to as "outward movement" (i.e., defined as the opposite word of "homeward movement" herein) hereafter as long as the context allows. The discharging of ink drops starts at the point in time E1 shown in FIG. 5A, and ends at the point in time E2 shown in FIG. 5B. This means that the print target area, at which printing is performed, is defined as a region where the carriage 3 travels during a time period between the point in time E1 and the point in time E2. The CPU 39 performs computation for driving mode switchover when the carriage 3 reaches the away position after traveling along the MS direction. In the unidirectional printing, the printing paper P is fed in the SS direction during the homeward movement of the carriage 3, that is, during a time period in which the carriage 3 travels along the MS direction from the away position to the home position thereof. Printing is not performed on the printing paper P during the homeward movement of the carriage 3. Printing is carried out through the repetitions of these outward and homeward movements of the carriage 3 as well as the feeding of the printing paper P in the SS direction meanwhile. Upon completion of printing, the printing paper P is ejected out of the printer 1 by means of the paper ejection drive roller 15 and the paper ejection slave roller 29.

When the CPU 39 receives various kinds of signals, it performs pattern switchover. In the present embodiment of the invention, it is assumed that four velocity curves A1-A4 are stored in the ROM 41. Accordingly, the pattern switchover is carried out by means of these four velocity curves. As illustrated in FIG. 6, as the first step shown in the flowchart thereof, the CPU 39 judges whether the dot size version is "VSD3" or not (step S101). Herein, the term "VSD3" is defined as a specific dot size version for high-quality printing. If the dot size version is "VSD3", it is possible to reduce dot size because the discharge amount of ink for VSD3 is relatively small. Since the dot size is made smaller, it is possible to print images with a higher resolution, featuring the output resolution of "2,880 dpi (V) times 720 dpi (H)". The control instruction unit 40 transmits the information on the dot size version as a signal related to resolution to the CPU 39. If it is judged as NO in the step S101, the driving modes are switched over to select the velocity data corresponding to the velocity curve A1 (step S108). Then, a signal for scanning the carriage 3 in accordance with the velocity curve A1 is transmitted to the motor driver 53. Accordingly, the carriage 3 reciprocates in the MS direction on the basis of the velocity curve A1. That is, the carriage 3 travels at the scanning speed based on the velocity curve A1 during both of its outward movement and homeward movement. During the outward movement, the carriage 3 performs printing (step S112). Subsequently, the value of BB, which indicates a global variable, is incremented by "1" (i.e., addition of "1" to the value of BB) (step S113). At the point in time at which the carriage 3 reaches its away position, the processing flow returns to the start of the switchover loop described herein. Then, next velocity data switchover processing is started. In addition thereto, the carriage 3 moves to its home position. It should be noted that the default value of BB is set as "0". This value is reset to "0" each time when a paper is fed.

It is assumed that the result of judgment made at the step S101 is, again, NO after returning to the start of this switchover loop. If so, the velocity curve A1 is selected (step S108). Accordingly, the carriage 3 travels at the scanning speed based on the velocity curve A1 during both of its outward movement and homeward movement, while performing printing during its outward movement (step S112). If decisions made at the step S101 continue to be NO, in other words, if the dot size version is not "VSD3", it means that images with high resolution are not required. In such a case, printing is performed on the basis of the same velocity curve without requiring (switchover among) a plurality of velocity curves.

If it is judged as YES in the step S101, the CPU 39 further judges whether to perform so-called unidirectional printing or not, that is, whether to discharge ink during the outward movement of the carriage 3 only or not (step S102). A signal indicating whether to perform unidirectional printing or not is transmitted from the control instruction unit 40 to the CPU 39. If it is judged as NO in the step S102, the driving modes are switched over to select the velocity data corresponding to the velocity curve A1 (step S108). Then, a signal for scanning the carriage 3 in accordance with the velocity curve A1 is transmitted to the motor driver 53. Accordingly, the carriage 3 reciprocates in the MS direction on the basis of the velocity curve A1. The carriage 3 travels at the scanning speed based on the velocity curve A1 during both of its outward movement and homeward movement. Herein, since the decision made at the step S102 is NO, the carriage 3 performs so-called bidirectional printing; that is, the carriage 3 discharges ink both during the outward movement and the homeward movement thereof (step S112). Subsequently, the value of BB, which indicates a global variable, is incremented by "1" (step S113). At the point in time at which the carriage 3 reaches its away position, the processing flow returns to the start of the switchover loop described herein. Then, next velocity data switchover processing is started. In addition thereto, the carriage 3 moves to its home position.

On the other hand, if the decision made at the step S102 is YES, the CPU 39 divides the value of the variable BB by 4 to calculate a local variable CC, which is the value of the remainder of such a division (step S103). Thereafter, the CPU 39 judges whether the value of the variable CC is "0" or not (step S104). If the value of the variable CC is "0", the CPU 39 switches the driving modes so as to select the velocity data corresponding to the velocity curve A1 (step S109), and then transmits a signal for scanning the carriage 3 in accordance with the velocity curve A1 to the motor driver 53. Then, the carriage 3 performs printing at the scanning speed based on the velocity curve A1 during its outward movement (step S112). Subsequently, the value of BB, which indicates a global variable, is incremented by "1" (step S113). At the point in time at which the carriage 3 reaches its away position, the processing flow returns to the start of the switchover loop described herein. Then, next velocity data switchover processing is started. In addition thereto, the carriage 3 moves to its home position.

If the results of judgment made both at the step S101 and the step S102 are YES after returning to the start of this switchover loop, then, the value of the variable CC is calculated in the step S103. It should be noted that the value of the variable BB is incremented by "1" in the previous flow processing in this switchover loop. If the value of the variable CC calculated in the previous flow processing is "0", it is judged as "1" this time. Then, the CPU 39 judges whether the value of the variable CC is "1" or not (step S105). If the value of the variable CC is judged as "1", the CPU 39 switches the driving modes so as to select the velocity data corresponding to the velocity curve A2 (step S110), and then transmits a signal for scanning the carriage 3 in accordance with the velocity curve A2 to the motor driver 53. Then, the carriage 3 performs printing at the scanning speed based on the velocity curve A2 during its outward movement (step S112). Subsequently, the value of BB, which indicates a global variable, is incremented by "1" (step S113). At the point in time at which the carriage 3 reaches its away position, the processing flow returns to the start of the switchover loop described herein. Then, next velocity data switchover processing is started. In addition thereto, the carriage 3 moves to its home position.

Next, if the results of judgment made both at the step S101 and the step S102 are YES again after returning to the start of this switchover loop, then, the value of the variable CC is calculated in the step S103. It should be noted that the value of the variable BB is incremented by "1" in the previous flow processing in this switchover loop. If the value of the variable CC calculated in the previous flow processing is "1", it is judged as "2" this time. Then, the CPU 39 judges whether the value of the variable CC is "2" or not (step S106). If the value of the variable CC is judged as "2", the CPU 39 switches the driving modes so as to select the velocity data corresponding to the velocity curve A3 (step S111), and then transmits a signal for scanning the carriage 3 in accordance with the velocity curve A3 to the motor driver 53. Then, the carriage 3 performs printing at the scanning speed based on the velocity curve A3 during its outward movement (step S112). Subsequently, the value of BB, which indicates a global variable, is incremented by "1" (step S113). At the point in time at which the carriage 3 reaches its away position, the processing flow returns to the start of the switchover loop described herein. Then, next velocity data switchover processing is started. In addition thereto, the carriage 3 moves to its home position.

Next, if the results of judgment made both at the step S101 and the step S102 are YES again after returning to the start of this switchover loop, then, the value of the variable CC is calculated in the step S103. It should be noted that the value of the variable BB is incremented by "1" in the previous flow processing in this switchover loop. If the value of the variable CC calculated in the previous flow processing is "2", it is judged as "3" this time. Consequently, the CPU 39 switches the driving modes so as to select the velocity data corresponding to the velocity curve A4 (step S107), and then transmits a signal for scanning the carriage 3 in accordance with the velocity curve A4 to the motor driver 53. Then, the carriage 3 performs printing at the scanning speed based on the velocity curve A4 during its outward movement (step S112). Subsequently, the value of BB, which indicates a global variable, is incremented by "1" (step S113). At the point in time at which the carriage 3 reaches its away position, the processing flow returns to the start of the switchover loop described herein. Then, next velocity data switchover processing is started. In addition thereto, the carriage 3 moves to its home position.

As described above, if it is decided YES successively in the steps S101 and S102, the velocity patterns for respective travels of the carriage 3 are switched over in such a manner that four times of reciprocating movements constitute one unit of operation. In addition, when the decisions made at the steps S101 and S102 are successive YES, the velocity curves are switched over among A1, A2, A3, and A4, in the order of appearance herein, in a sequential manner for respective travels (i.e., corresponding to the above-mentioned four times of reciprocating movements) in the unit of operation. The above series of operations is repeated until printing is completed. When the velocity curves are switched over sequentially in the order of A1, A2, A3, and A4 as described above, resonance vibrations occur at D1, D2, D3, and D4 during acceleration as illustrated in FIG. 5A and at D5, D6, D7, and D8 during deceleration as illustrated in FIG. 5B, that is, four different points in time each for acceleration and deceleration after the start of scanning (i.e., movement or travel) of the carriage 3.

Figure 7A:
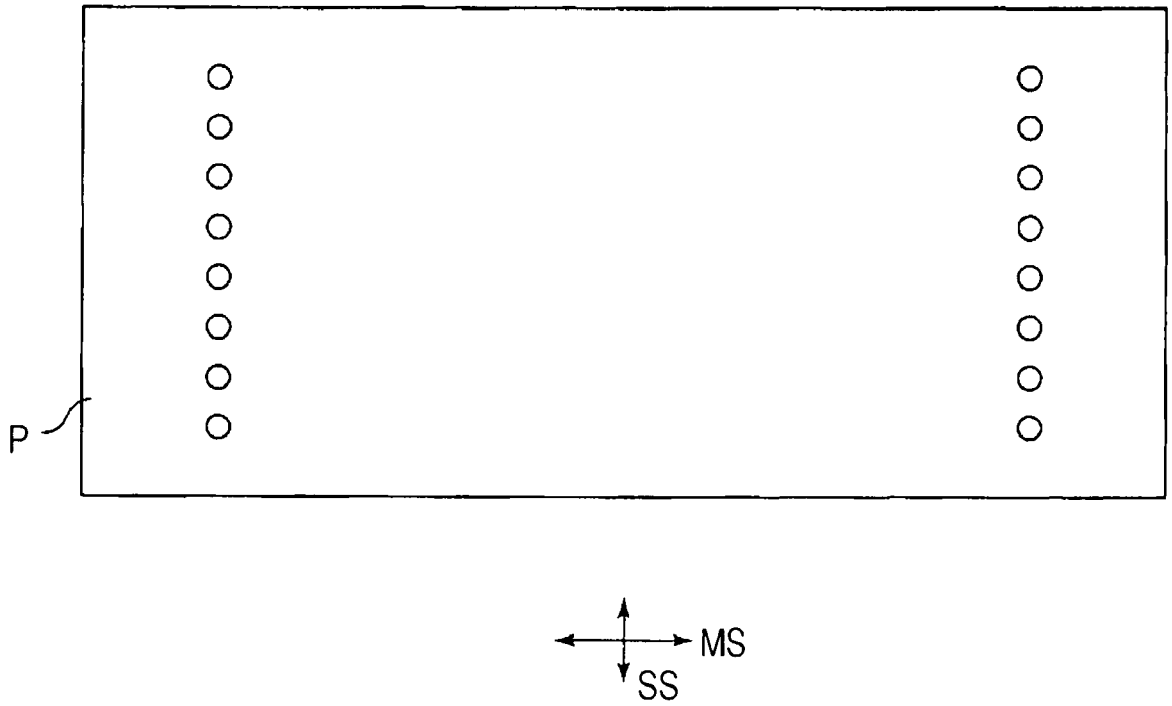
FIG. 7 is a set of explanatory diagrams that illustrates the comparative print results that appear on a paper P after printing performed by means of the driving mode switchover section.
Figure 7B:
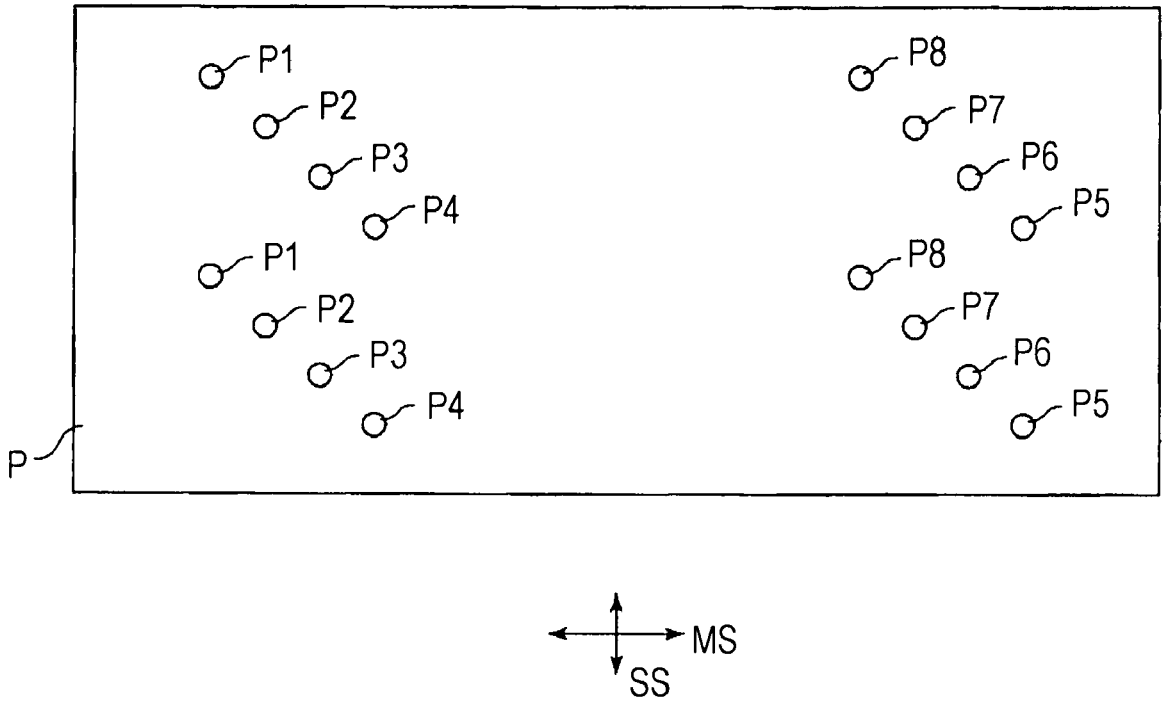

As described above, each of D1-D4 and D5-D8 is a point at which the printer 1 vibrates in resonance. For this reason, the carriage 3 vibrates at each of D1-D4 and D5-D8, which might cause uneven printing. If the same velocity curve is used, resonance vibrations are generated at the same points in time. Therefore, as illustrated in FIG. 7A, each set of the points D1-D4 and the points D5-D8 is aligned in the SS direction on the printing paper P, which is recognized (i.e., observed or perceived) as "rainbow unevenness". In contrast, if the CPU 39 switches over the velocity curves among A1, A2, A3, and A4 for print execution, as illustrated in FIG. 7B, the points D1-D4 and the points D5-D8 are staggered with respect to one another (i.e., spread or scattered) in the MS direction of the printing paper P. Therefore, these points do not form two lines along the SS direction. Thus, no rainbow unevenness appears on the paper P after completion of printing.

In the printer 1 configured as above, a driving mode switchover section 45 switches over among four velocity curves A1-A4, which have four acceleration inclinations and four deceleration inclinations that vary from one another, so as to move the carriage 3. With such a structure, it is possible to shift (i.e., stagger) points in time at which the carriage 3 is affected by vibrations, that is, points in time at which unevenness in printing occurs. As a consequence thereof, as illustrated in FIG. 7B, the points D1-D4 and the points D5-D8 at which unevenness in printing could occur are staggered with respect to one another in the MS direction of the printed paper P (i.e., the printing paper P after completion of printing). Therefore, uneven points will never be aligned (in two lines) along the SS direction. Thus, the invention makes it possible to effectively avoid the generation of rainbow unevenness on the printed paper P (i.e., after completion of printing).

According to the exemplary configuration of the printer 1 described above, the pattern switchover is carried out in accordance with printing direction, that is, either bidirectional printing or unidirectional printing, as well as printing resolution. Specifically, the pattern switchover is executed by means of the velocity curves A1-A4 if high-resolution unidirectional printing is performed. Therefore, it is possible to adjust printing precision (i.e., actual print quality) depending on required print quality. The pattern switchover is carried out either for each outward movement or for each set of outward and homeward movements of the carriage 3. Therefore, it is possible to apply the switchover (technique) of the scanning speeds of the carriage 3 according to the invention to both of bidirectional printing and unidirectional printing. Thus, the invention increases the diversification of printing that is performed by the printer 1.

According to the exemplary configuration of the printer 1 described above, printing is started during acceleration of the carriage 3. After the start of printing, it is continued until the carriage 3 decelerates. Therefore, the invention makes it possible to provide a "marginless" printing, that is, printing with no margin left at edges of the printing paper P, or printing with relatively narrow margins left thereat. Thus, the invention makes it possible to offer high-quality printing.

Second Embodiment

With reference to accompanying drawings, a printing apparatus 70 according to a second exemplary embodiment of the invention is described below. It should be noted that, in the following description of the printer 70 according to the second exemplary embodiment of the invention, the same reference numerals are consistently used for the same components as those of the printer 1 according to the first exemplary embodiment of the invention so as to omit any redundant explanation or simplify explanation thereof.

Figure 8:
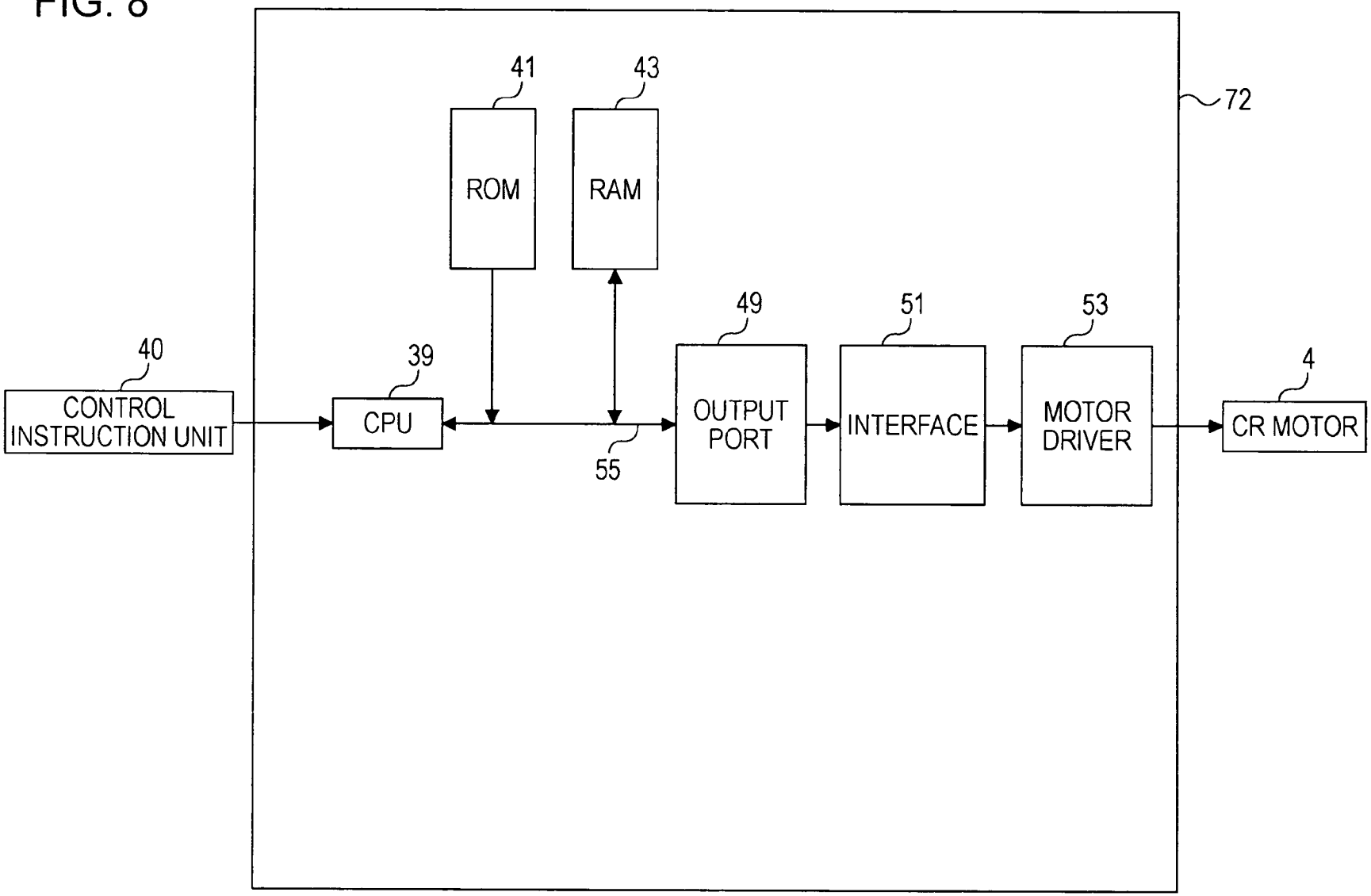
FIG. 8 is a block diagram that schematically illustrates an example of the configuration of a control unit according to the second exemplary embodiment of the invention.

FIG. 8 is a block diagram that schematically illustrates an example of the configuration of a control unit 72, which controls the CR motor 4 in the printer 70.

Note that the configuration of the printer 70 is the same as that of the counterpart illustrated in the first embodiment of the invention described above. In the configuration of the printer 70, the control unit 72, which functions as a control section, is in charge of controlling the driving speed of the CR motor 4. As illustrated in FIG. 8, the control unit 72 is provided with the CPU 39, the ROM 41, the RAM 43, the output port 49, the interface 51, and the motor driver 53. These components are interconnected with one another via the bus 55, which is a group of signal lines. The CPU 39 serves as a movement position switchover section (as recited in the appended claims), which switches over "movement start positions" in the MS direction of the carriage 3. In the present embodiment of the invention, data of velocity curve A1 (i.e., velocity data corresponding to time) is stored in the ROM 41.

In the following description, a printing operation that is performed when the CPU 39 switches movement start positions is explained.

Figure 9:
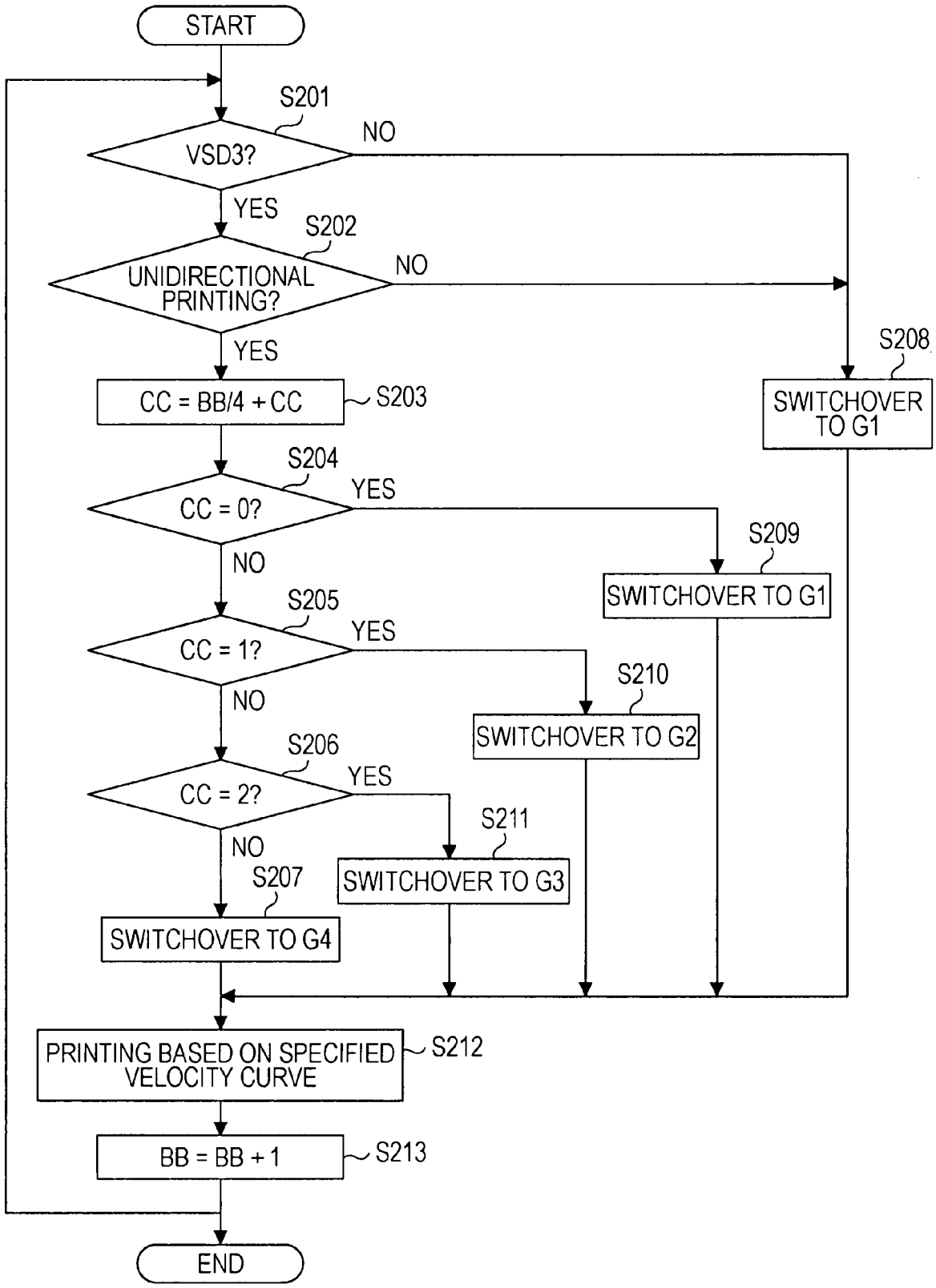
FIG. 9 is a flowchart that illustrates the operational flow of switchover processing performed by a movement position switchover section.
Figure 10A:
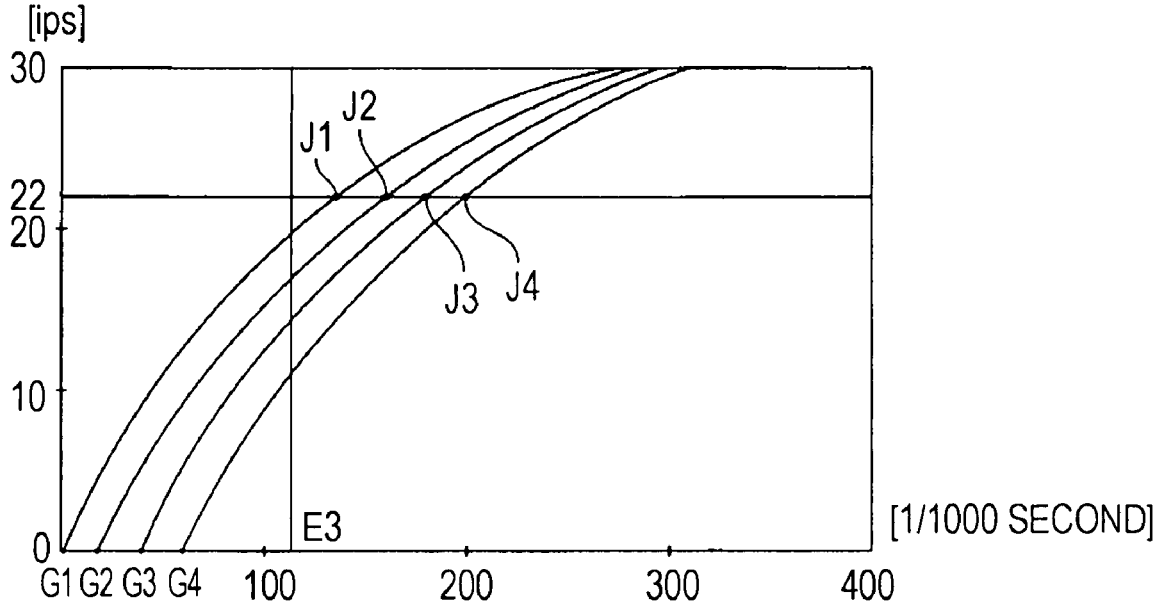
FIG. 10 is a set of diagrams that illustrates the scanning speeds of a carriage that correspond to a plurality of movement positions switched over therebetween.
Figure 10B:
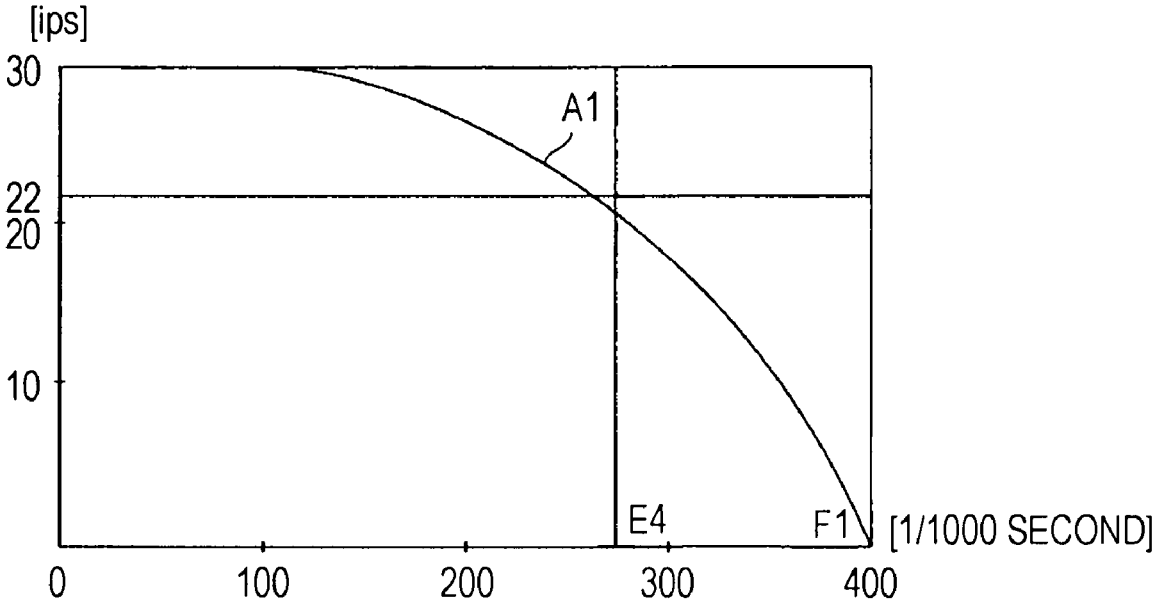

FIG. 9 is a flowchart that illustrates the operational flow of movement start position switchover processing, which is performed by the CPU 39 (move position switchover section). FIG. 10 is a set of diagrams that illustrates velocity curves in the scanning of the carriage 3; specifically, it illustrates the velocity curves that are used when the movement start positions of the carriage 3 are switched over. FIG. 10A illustrates the velocity curves that apply during acceleration of the carriage 3. On the other hand, FIG. 10B illustrates the velocity curve (i.e., a single curve) that applies during deceleration thereof. In each of FIGS. 10A and 10B, the horizontal axis represents time where the driving start of the carriage 3 is taken as zero. The vertical axis in each of FIGS. 10A and 10B represents the scanning speed of the carriage 3.

When printing is performed, as the first step, the control instruction unit 40 receives print-related data such as paper size, paper type, resolution, printing mode, unidirectional printing or bidirectional printing, color adjustment, and so on. Upon reception of these data, the control instruction unit 40 supplies a signal based on the received data to the CPU 39. As the next step, the CPU 39 reads out movement-start-position data as well as velocity data stored in the ROM 41 or the RAM 43 on the basis of the input signal supplied from the control instruction unit 40. In the present embodiment of the invention, it is assumed that printing is performed under a MicroWeave printing mode.

In the present embodiment of the invention, it is assumed that so-called unidirectional printing is performed. As has already been described, in the unidirectional printing, ink drops are discharged from the print head 2 onto the printing paper P during a time period in which the carriage 3 travels along the MS direction from the home position to the away position thereof, which is referred to as outward movement and defined as the opposite word of homeward movement in this specification. The discharging of ink drops starts at the point in time E3 shown in FIG. 10A, and ends at the point in time E4 shown in FIG. 10B. This means that the print target area, at which printing is performed, is defined as a region where the carriage 3 travels during a time period between the point in time E3 and the point in time E4. The CPU 39 performs computation for movement start position switchover when the carriage 3 reaches the away position after traveling along the MS direction.

When the CPU 39 receives various kinds of signals, it performs pattern switchover. As has already been described, in the present embodiment of the invention, the velocity data stored in the ROM 41 includes data pertaining to the velocity curve A1 only. Therefore, the carriage 3 is moved on the basis of the velocity curve A1. As illustrated in FIG. 9, as the first step of the pattern switchover shown in the flowchart thereof, the CPU 39 judges whether the dot size version is "VSD3" or not (step S201). The definition of the term "VSD3" in this embodiment is the same as that of the first embodiment of the invention described above. If the dot size version is not "VSD3", that is, if the decision made at the step S201 is NO, the CPU 39 reads, out of the ROM 41, data that specifies G1 as the position at which the movement of the carriage 3 is started, and effects a switchover so as to set the movement start position of the carriage 3 at G1 as illustrated in FIG. 10A (step S208). That is, a signal that causes the carriage 3 to start its outward movement at the position G1 on the basis of the velocity curve A1 is transmitted to the motor driver 53. It should be noted that the movement stop position of the carriage 3 is not switched over in this pattern switchover processing. Accordingly, as illustrated in FIG. 10B, the movement stop position of the carriage 3 is constantly set at a position F1. By this means, the carriage 3 starts its outward movement at the position G1, and travels along the MS direction to stop its movement at the position F1. That is, printing is performed at the scanning speed based on the velocity curve A1 in such a manner that the carriage 3 starts its outward movement at the movement start position G1 and ends its outward movement at the movement stop position F1 (step S212). Subsequently, the value of BB, which indicates a global variable, is incremented by "1" (step S213). At the point in time at which the carriage 3 reaches its away position, the processing flow returns to the start of the switchover loop described herein. Then, next movement start position switchover processing is started. In addition thereto, the carriage 3 moves to its home position. It should be noted that the default value of BB is set as "0". This value is reset to "0" each time when a paper is fed.

It is assumed that the result of judgment made at the step S201 is, again, NO after returning to the start of this switchover loop. If so, the movement start position G1 is selected (step S208). Accordingly, the carriage 3 travels at the scanning speed based on the velocity curve A1 so as to perform its outward movement, which starts at the movement start position G1 and ends at the movement stop position F1, while performing printing during the above-mentioned outward movement (step S212). If decisions made at the step S201 continue to be NO in this switchover loop, in other words, if the dot size version is not "VSD3", it means that images with high resolution are not required. In such a case, the carriage 3 continues to start its outward movements at the same movement start position, that is, the position G1, so as to perform printing.

If the decision made at the step S201 is YES after returning to the start of this switchover loop, the CPU 39 further judges whether to perform unidirectional printing or not, that is, whether to discharge ink during the outward movement of the carriage 3 only or not (step S202). If the decision made at the step S202 is NO, the CPU 39 effects a switchover so that the movement start position of the carriage 3 is set at G1 (step S208). That is, a signal that causes the carriage 3 to start its outward movement at the position G1 and end its outward movement at the position F1 on the basis of the velocity curve A1 and causes the carriage 3 to start its homeward movement at the position F1 and end its homeward movement at the position G1 on the basis thereof is transmitted to the motor driver 53. Accordingly, so-called bidirectional printing is performed at the scanning speed based on the velocity curve A1 during both of the outward movement and the homeward movement of the carriage 3 in such a manner that the carriage 3 starts its outward movement at the movement start position G1 and ends its outward movement at the movement stop position F1 and that the carriage 3 starts its homeward movement at the movement start position F1 and ends its homeward movement at the movement stop position G1 (step S212). In the bidirectional printing, the carriage 3 discharges ink both during the outward movement and the homeward movement thereof. Subsequently, the value of BB, which indicates a global variable, is incremented by "1" (step S213). At the point in time at which the carriage 3 reaches its away position, the processing flow returns to the start of the switchover loop described herein. Then, next movement position switchover processing is started. In addition thereto, the carriage 3 moves to its home position.

On the other hand, if the decision made at the step S202 is YES, the CPU 39 divides the value of the variable BB by 4 to calculate a local variable CC, which is the value of the remainder of such a division (step S203). Then, the CPU 39 judges whether the value of the variable CC is "0" or not (step S204). If it is judged that the value of the variable CC is "0" (step S204), the CPU 39 effects a switchover so that the movement start position of the carriage 3 is set at G1 (step S209). That is, a signal that causes the carriage 3 to start its outward movement at the position G1 and end its outward movement at the position F1 on the basis of the velocity curve A1 is transmitted to the motor driver 53. Then, printing is performed at the scanning speed based on the velocity curve A1 in such a manner that the carriage 3 starts its outward movement at the movement start position G1 and ends its outward movement at the movement stop position F1 (step S212). Subsequently, the value of BB, which indicates a global variable, is incremented by "1" (step S213). At the point in time at which the carriage 3 reaches its away position, the processing flow returns to the start of the switchover loop described herein. Then, next movement start position switchover processing is started. In addition thereto, the carriage 3 moves to its home position.

If the results of judgment made both at the step S201 and the step S202 are YES after returning to the start of this switchover loop, then, the value of the variable CC is calculated in the step S203. It should be noted that the value of the variable BB is incremented by "1" in the previous flow processing in this switchover loop. If the value of the variable CC calculated in the previous flow processing is "0", it is judged as "1" this time. Then, the CPU 39 judges whether the value of the variable CC is "1" or not (step S205). If it is judged that the value of the variable CC is "1", the CPU 39 effects a switchover so that the movement start position of the carriage 3 is set at G2 (step S210). That is, a signal that causes the carriage 3 to start its outward movement at the position G2 and end its outward movement at the position F1 on the basis of the velocity curve A1 is transmitted to the motor driver 53. Accordingly, printing is performed during the outward movement of the carriage 3 at the scanning speed based on the velocity curve A1 in such a manner that the carriage 3 starts the above-mentioned outward movement at the movement start position G2 and ends the above-mentioned outward movement at the movement stop position F1 (step S212). Subsequently, the value of BB, which indicates a global variable, is incremented by "1" (step S213). At the point in time at which the carriage 3 reaches its away position, the processing flow returns to the start of the switchover loop described herein. Then, next movement start position switchover processing is started. In addition thereto, the carriage 3 moves to its home position.

Next, if the results of judgment made both at the step S201 and the step S202 are YES again after returning to the start of this switchover loop, then, the value of the variable CC is calculated in the step S203. It should be noted that the value of the variable BB is incremented by "1" in the previous flow processing in this switchover loop. If the value of the variable CC calculated in the previous flow processing is "1", it is judged as "2" this time. Then, the CPU 39 judges whether the value of the variable CC is "2" or not (step S206). If it is judged that the value of the variable CC is "2", the CPU 39 effects a switchover so that the movement start position of the carriage 3 is set at G3 (step S211). That is, a signal that causes the carriage 3 to start its outward movement at the position G3 and end its outward movement at the position F1 on the basis of the velocity curve A1 is transmitted to the motor driver 53. Accordingly, printing is performed during the outward movement of the carriage 3 at the scanning speed based on the velocity curve A1 in such a manner that the carriage 3 starts the above-mentioned outward movement at the movement start position G3 and ends the above-mentioned outward movement at the movement stop position F1 (step S212). Subsequently, the value of BB, which indicates a global variable, is incremented by "1" (step S213). At the point in time at which the carriage 3 reaches its away position, the processing flow returns to the start of the switchover loop described herein. Then, next movement start position switchover processing is started. In addition thereto, the carriage 3 moves to its home position.

Next, if the results of judgment made both at the step S201 and the step S202 are YES again after returning to the start of this switchover loop, then, the value of the variable CC is calculated in the step S203. It should be noted that the value of the variable BB is incremented by "1" in the previous flow processing in this switchover loop. If the value of the variable CC calculated in the previous flow processing is "2", it is judged as "3" this time. If it is judged that the value of the variable CC is "3", the CPU 39 effects a switchover so that the movement start position of the carriage 3 is set at G4 (step S207). That is, a signal that causes the carriage 3 to start its outward movement at the position G4 and end its outward movement at the position F1 on the basis of the velocity curve A1 is transmitted to the motor driver 53. Accordingly, printing is performed during the outward movement of the carriage 3 at the scanning speed based on the velocity curve A1 in such a manner that the carriage 3 starts the above-mentioned outward movement at the movement start position G4 and ends the above-mentioned outward movement at the movement stop position F1 (step S212). Subsequently, the value of BB, which indicates a global variable, is incremented by "1" (step S213). At the point in time at which the carriage 3 reaches its away position, the processing flow returns to the start of the switchover loop described herein. Then, next movement start position switchover processing is started. In addition thereto, the carriage 3 moves to its home position.

As described above, if it is decided YES each in the steps S201 and S202 by the CPU 39, the movement positions for respective travels of the carriage 3 are switched over in such a manner that four times of reciprocating movements constitute one unit of operation. In addition, when the decisions made at the steps S201 and S202 are successive YES, the movement start positions are switched over among G1, G2, G3, and G4, in the order of appearance herein, in a sequential manner for respective travels (i.e., corresponding to the above-mentioned four times of reciprocating movements) in the unit of operation. The above series of operations is repeated until printing is completed. When the movement start positions are switched over sequentially in the order of G1, G2, G3, and G4 as described above, resonance vibrations occur at J1, J2, J3, and J4 during acceleration as illustrated in FIG. 10A, that is, four different points in time.

As described above, each of J1-J4 is a point at which the carriage 3 is affected by vibration. Therefore, if the CPU 39 performs a switchover according to the present embodiment of the invention, it is possible to stagger points in time at which the printer 70 vibrates in resonance, in other words, points in time at which unevenness in printing occurs. As a consequence thereof, in the same (or similar) manner as the first embodiment of the invention described above does, the present embodiment thereof offers advantageous effects in that the points J1-J4 at which unevenness in printing could occur are staggered with respect to one another in the MS direction of the paper P after completion of printing. Therefore, uneven points will never be aligned along the SS direction. Thus, no rainbow unevenness appears on the paper P after completion of printing.

In the printer 70 configured as above, the CPU 39 causes the carriage 3 to travel while switching over the movement start positions thereof among G1, G2, G3, and G4 in a sequential manner. With such a structure, it is possible to shift (i.e., stagger) points in time at which the carriage 3 is affected by vibrations, that is, points in time at which unevenness in printing occurs. As a consequence thereof, the points J1-J4 shown in FIG. 10A at which unevenness in printing could occur are staggered (i.e., shifted) with respect to one another. Therefore, uneven points will never be aligned along the SS direction but will be spread in the MS direction of the printing paper P after completion of printing. Thus, the invention makes it possible to effectively avoid the generation of rainbow unevenness on the printing paper P after completion of printing.

According to the exemplary configuration of the printer 70 described above, the pattern switchover is carried out in accordance with printing direction, that is, either bidirectional printing or unidirectional printing, as well as printing resolution. Specifically, the movement start position pattern switchover is executed if high-resolution unidirectional printing is performed. Therefore, it is possible to adjust actual print quality, that is, printing precision, depending on required print quality. The pattern switchover is carried out either for each outward movement or for each set of outward and homeward movements of the carriage 3. Therefore, it is possible to apply the switchover (technique) of the scanning positions of the carriage 3 according to the invention to both of bidirectional printing and unidirectional printing. Thus, the invention increases the diversification of printing that is performed by the printer 70.

According to the exemplary configuration of the printer 70 described above, printing is started during acceleration of the carriage 3. After the start of printing, it is continued until the carriage 3 decelerates. Therefore, the invention makes it possible to provide a marginless printing, that is, printing with no margin left at edges of the printing paper P, or printing with relatively narrow margins left thereat. Thus, the invention makes it possible to offer high-quality printing.

Third Embodiment

With reference to accompanying drawings, a printing apparatus 80 according to a third exemplary embodiment of the invention is described below. It should be noted that, in the following description of the printer 80 according to the third exemplary embodiment of the invention, the same reference numerals are consistently used for the same components as those of the printer 1 according to the first exemplary embodiment of the invention so as to omit any redundant explanation or simplify explanation thereof.

Figure 11:
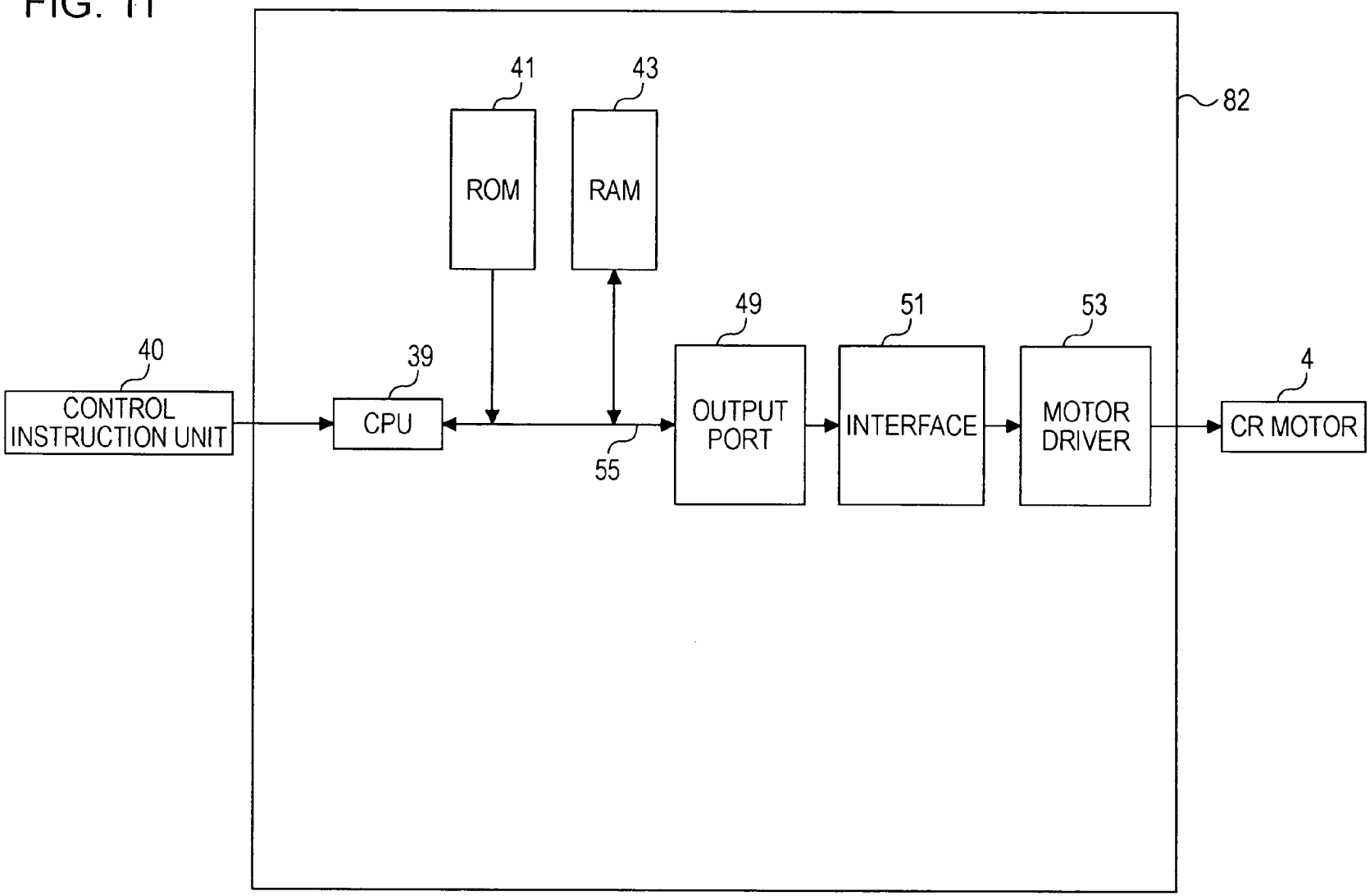
FIG. 11 is a block diagram that schematically illustrates an example of the configuration of a control unit according to the third exemplary embodiment of the invention.

FIG. 11 is a block diagram that schematically illustrates an example of the configuration of a control unit 82, which controls the CR motor 4 in the printer 80.

Note that the configuration of the printer 80 is the same as that of the counterpart illustrated in the first embodiment of the invention described above. In the configuration of the printer 80, the control unit 82, which functions as a control section, is in charge of controlling the driving speed of the CR motor 4. As illustrated in FIG. 8, the control unit 82 is provided with the CPU 39, the ROM 41, the RAM 43, the output port 49, the interface 51, and the motor driver 53. These components are interconnected with one another via the bus 55, which is a group of signal lines. The CPU 39 functions as a switchover judgment section (as recited in the appended claims) that makes a proper decision as to which one of the switchover methods described in the foregoing exemplary embodiments of the invention, that is, either the driving mode switchover or the movement start position switchover, should be used, and performs a switchover as a result of the decision made in accordance with a signal indicating paper size and paper type.

In the present embodiment of the invention, the CPU 39 makes a decision to selectively use the driving mode switchover or the movement start position switchover so as to perform the pattern switchover (in an illustrated example which is described below, the CPU 39 makes a decision to selectively use either the driving mode switchover or the movement start position switchover for acceleration, while using the driving mode switchover consistently for deceleration). Such a selection is made based on, for example, paper size. Data pertaining to paper size can be received at the control instruction unit 40. The control instruction unit 40 supplies the set paper size data to the CPU 39. The CPU 39, which serves as a print target medium recognition section (as recited in the appended claims), detects the size of the print target paper. Next, the CPU 39, which further functions as the switchover judgment section, makes a decision as to which one of the above should be used, that is, either the driving mode switchover or the movement start position switchover. Among a variety of paper sizes, "A3", "A4", and "B5" are known as popular ones. On the basis of the input signal that is supplied from the control instruction unit 40, the CPU 39 reads out either the velocity data or the movement start position data stored in the ROM 41 or the RAM 43. Next, the CPU 30 performs arithmetic processing in accordance with the program.

In the following example, an explanation is given of how the CPU 39 makes a decision to selectively use the driving mode switchover or the movement start position switchover on the basis of paper sizes. In the present embodiment of the invention, a set of the above-mentioned popular paper sizes, that is, "A3", "A4", and "B5", is taken as an example for the purpose of explanation.

Figure 12:
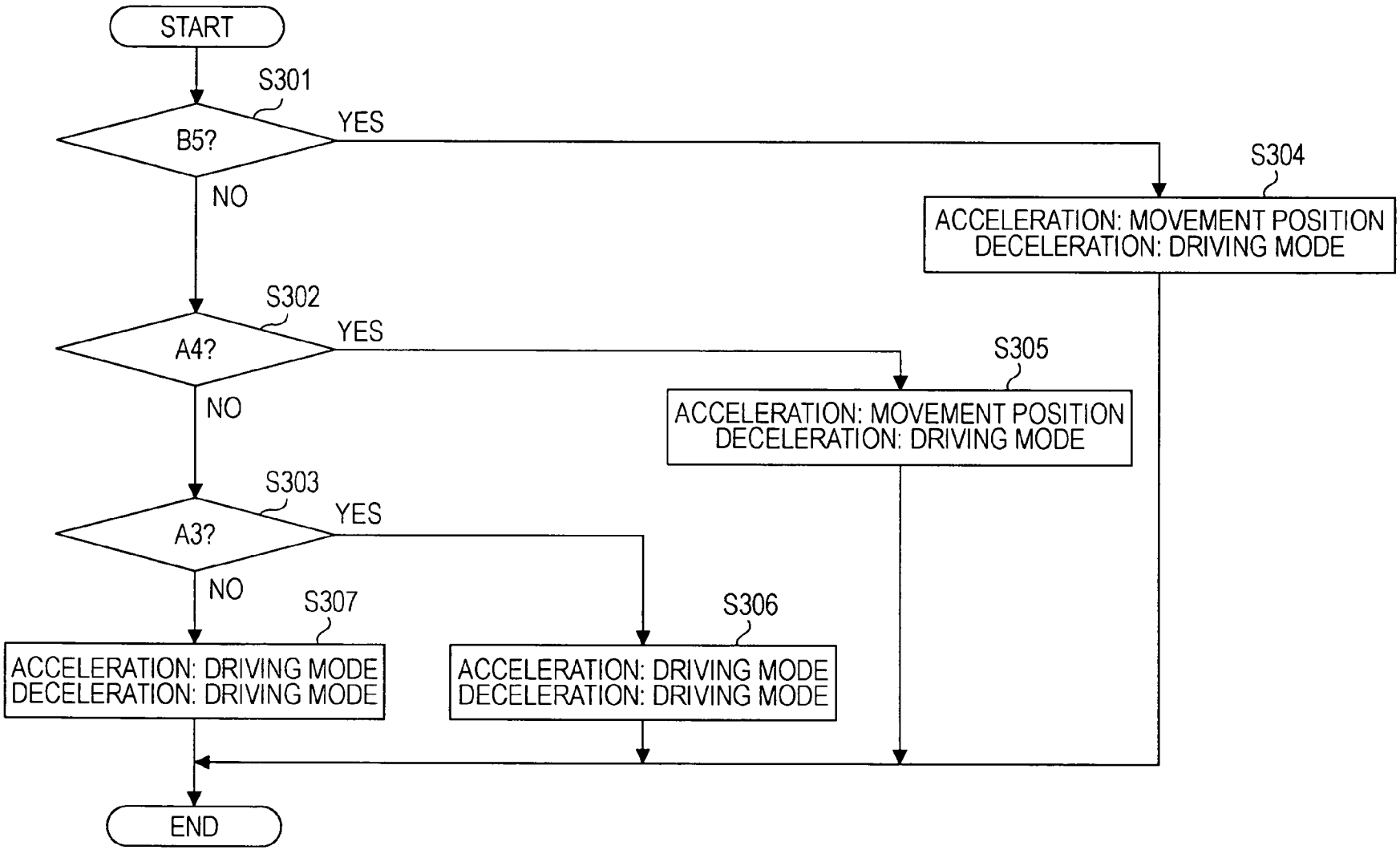
FIG. 12 is a flowchart that illustrates the operational flow of switchover processing performed by a switchover judgment section.

FIG. 12 is a flowchart that illustrates the operational flow of driving mode switchover processing and the movement start position switchover processing performed on the basis of paper sizes.

Upon reception of a signal indicating the paper size of the printing paper P, the CPU 39 judges whether the indicated paper size is "B5" or not (step S301). If the CPU 39 judges that the indicated paper size is "B5" (step S301: YES), it determines that the movement start position switchover should be used for acceleration of the carriage 3 whereas the driving mode switchover should be used for deceleration thereof (step S304). When the indicated paper size is "B5", which is relatively small, there is a relatively wide space between the home position of the carriage 3 and the "home-position-side" end of the print target paper. Therefore, in such a case, it is possible to perform a pattern switchover by switching the movement start position of the carriage 3 while utilizing the above-mentioned relatively wide space between the home position of the carriage 3 and the home-position-side end of the print target paper.

On the other hand, if the CPU 39 judges that the indicated paper size is not "B5" (step S301: NO), the CPU 39 further judges whether the indicated paper size is "A4" or not (step S302). If the CPU 39 judges that the indicated paper size is "A4" (step S302: YES), it determines that the movement start position switchover should be used for acceleration of the carriage 3 whereas the driving mode switchover should be used for deceleration thereof (step S305). When the indicated paper size is "A4", which is the middle size at least in this example, there is a sufficient space between the home position of the carriage 3 and the home-position-side end of the print target paper. Therefore, in such a case, it is possible to perform a pattern switchover by switching the movement start position of the carriage 3 while utilizing the above-mentioned sufficient space between the home position of the carriage 3 and the home-position-side end of the print target paper.

On the other hand, if the CPU 39 judges that the indicated paper size is not "A4" (step S302: NO), the CPU 39 further judges whether the indicated paper size is "A3" or not (step S303). If the CPU 39 judges that the indicated paper size is "A3" (step S303: YES), it determines that the driving mode switchover should be used for both acceleration and deceleration of the carriage 3 (step S306). When the indicated paper size is "A3", which is relatively large, there is not sufficient space between the home position of the carriage 3 and the home-position-side end of the print target paper. Therefore, in such a case, it is not possible to perform a pattern switchover by switching the movement start position of the carriage 3 because of the above-mentioned insufficient space between the home position of the carriage 3 and the home-position-side end of the print target paper.

If the CPU 39 judges that the indicated paper size is not "A3" (step S303: NO), it determines that the driving mode switchover should be used for both acceleration and deceleration of the carriage 3 (step S307).

Next, a printing operation that is performed for each paper size is explained.

Figure 13:
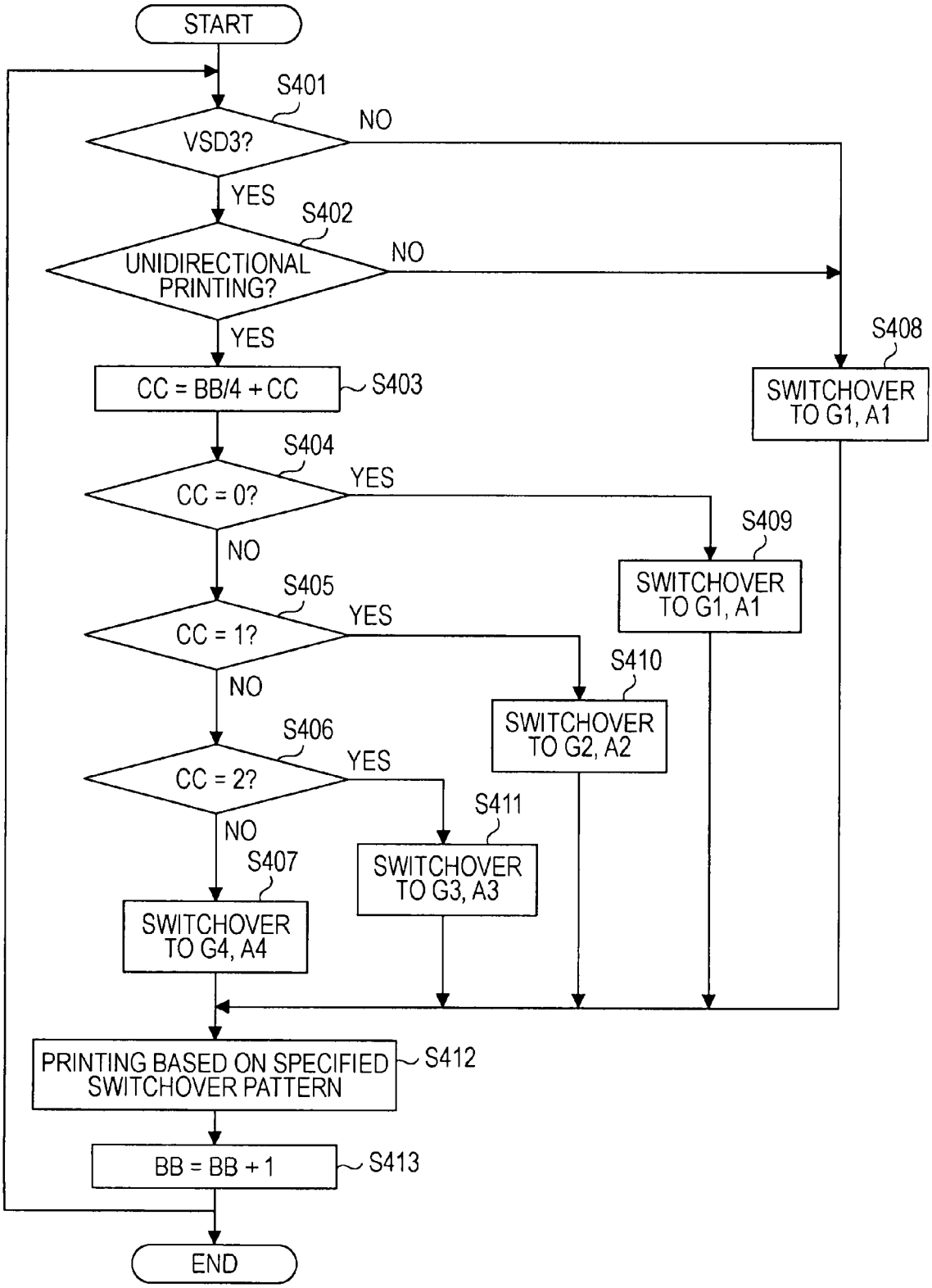
FIG. 13 is a flowchart that illustrates the operational flow of switchover processing performed on the basis of the size of a print target paper.

FIG. 13 is a flowchart that illustrates the operational flow of a pattern switchover that is performed when the paper size is either "B5" or "A4".

When printing is performed, as the first step, the control instruction unit 40 receives print-related data such as paper size, paper type, resolution, printing mode, unidirectional printing or bidirectional printing, color adjustment, and so on. Next, the control instruction unit 40 supplies the received data to the CPU 39. On the basis of the input data that is supplied from the control instruction unit 40, the CPU 39 reads out either the velocity data or the movement start position data stored in the ROM 41 or the RAM 43. Next, the CPU 30 performs arithmetic processing in accordance with the program. In the present embodiment of the invention, it is assumed that printing is performed under a MicroWeave printing mode.

In the present embodiment of the invention, it is assumed that so-called unidirectional printing is performed. As has already been described, in the unidirectional printing, ink drops are discharged from the print head 2 onto the printing paper P during a time period in which the carriage 3 travels along the MS direction from the home position to the away position thereof, which is referred to as outward movement and defined as the opposite word of homeward movement in this specification. The CPU 39 performs computation for the driving mode switchover and the movement start position switchover when the carriage 3 reaches the away position after traveling along the MS direction.

As has already been described, if the CPU 39 receives a signal indicating that the paper size of the print target paper is either "B5" or "A4", the movement start position switchover is used for acceleration of the carriage 3 whereas the driving mode switchover is used for deceleration thereof. In the present embodiment of the invention, data pertaining to the velocity curves A1-A4 as well as movement start positions is stored in the ROM 41. As illustrated in FIG. 13, as the first step of the pattern switchover shown in the flowchart thereof, if the indicated paper size is either "B5" or "A4", the CPU 39 judges whether the dot size version is "VSD3" or not (step S401). If the dot size version is not "VSD3", that is, if the decision made at the step S401 is NO, the CPU 39 reads data out of the ROM 41 so as to select G1 as the position at which the movement of the carriage 3 is started (refer to FIG. 10A) and A1 as the deceleration curve to be applied therefor (refer to FIG. 5B) (step S408). Accordingly, the CPU 39 transmits a signal for scanning the carriage 3 in accordance with the acceleration curve A1 from the movement start position G1 and scanning the carriage 3 in accordance with the deceleration curve A1 for its outward movement to the motor driver 53. Consequently, the carriage 3 travels in accordance with the velocity curve A1 during its acceleration from the movement start position G1 and in accordance with the velocity curve A1 during its deceleration in the outward movement thereof in the MS direction so as to perform printing (step S412). Subsequently, the value of BB, which indicates a global variable, is incremented by "1" (step S413). At the point in time at which the carriage 3 reaches its away position, the processing flow returns to the start of the switchover loop described herein. Then, next movement start position switchover processing/velocity data (deceleration curve) switchover processing is started. In addition thereto, the carriage 3 moves to its home position. It should be noted that the default value of BB is set as "0". This value is reset to "0" each time when a paper is fed.

It is assumed that the result of judgment made at the step S401 is, again, NO after returning to the start of this switchover loop. If so, the CPU 39 selects G1 as the position at which the movement of the carriage 3 is started (refer to FIG. 10A) and A1 as the deceleration curve to be applied therefor (refer to FIG. 5B) (step S408). Accordingly, the carriage 3 travels in accordance with the velocity curve (i.e., acceleration curve) A1 during its acceleration from the movement start position G1 and in accordance with the velocity curve (i.e., deceleration curve) A1 during its deceleration in the outward movement thereof so as to perform printing (step S412). If decisions made at the step S401 continue to be NO in this switchover loop, in other words, if the dot size version is not "VSD3", it means that images with high resolution are not required. In such a case, the carriage 3 continues to start its outward movements at the same movement start position, that is, the position G1, so as to perform printing.

If the decision made at the step S401 is YES after returning to the start of this switchover loop, the CPU 39 further judges whether to perform unidirectional printing or not, that is, whether to discharge ink during the outward movement of the carriage 3 only or not (step S402). If the decision made at the step S402 is NO, the CPU 39 reads data out of the ROM 41 so as to select G1 as the position at which the movement of the carriage 3 is started (refer to FIG. 10A) and A1 as the deceleration curve to be applied therefor (refer to FIG. 5B) (step S408). Then, the CPU 39 transmits a signal for accelerating the carriage 3 in accordance with the acceleration curve A1 from the position G1 and decelerating the carriage 3 in accordance with the deceleration curve A1 in its outward movement while accelerating the carriage 3 in accordance with the deceleration curve A1 and decelerating the carriage 3 in accordance with the acceleration curve A1 so as to make the carriage 3 stop at the position G1 in its homeward movement to the motor driver 53. Accordingly, the carriage 3 accelerates in accordance with the acceleration curve A1 after starting its travel from the movement start position G1 and decelerates in accordance with the deceleration curve A1 in the outward movement thereof. On the other hand, in its homeward movement, the carriage 3 accelerates in accordance with the deceleration curve A1 and decelerates in accordance with the acceleration curve A1 so as to stop its travel at the movement stop position G1. While traveling at the above scanning speeds, the carriage 3 performs so-called bidirectional printing in which it discharges ink both during the outward movement and the homeward movement thereof (step S412). Subsequently, the value of BB, which indicates a global variable, is incremented by "1" (step S413). At the point in time at which the carriage 3 reaches its away position, the processing flow returns to the start of the switchover loop described herein. Then, next movement start position switchover processing/velocity data (deceleration curve) switchover processing is started. In addition thereto, the carriage 3 moves to its home position.

On the other hand, if the decision made at the step S402 is YES, the CPU 39 divides the value of the variable BB by 4 to calculate a local variable CC, which is the value of the remainder of such a division (step S403). Thereafter, the CPU 39 judges whether the value of the variable CC is "0" or not (step S404). If it is judged that the value of the variable CC is "0", the CPU 39 effects a switchover so that the movement start position of the carriage 3 is set at G1, and that the acceleration curve A1 and the deceleration curve A1 are selected (step S409). Accordingly, the CPU 39 transmits, to the motor driver 53, a signal for scanning the carriage 3 in accordance with the acceleration curve A1 from the movement start position G1 and scanning the carriage 3 in accordance with the deceleration curve A1 for its outward movement. Consequently, the carriage 3 travels in accordance with the velocity curve A1 during its acceleration from the movement start position G1 and in accordance with the velocity curve A1 during its deceleration in the outward movement thereof in the MS direction so as to perform printing (step S412). Subsequently, the value of BB, which indicates a global variable, is incremented by "1" (step S413). At the point in time at which the carriage 3 reaches its away position, the processing flow returns to the start of the switchover loop described herein. Then, next movement start position switchover processing/velocity data (deceleration curve) switchover processing is started. In addition thereto, the carriage 3 moves to its home position.

If the results of judgment made both at the step S401 and the step S402 are YES after returning to the start of this switchover loop, then, the value of the variable CC is calculated in the step S403. It should be noted that the value of the variable BB is incremented by "1" in the previous flow processing in this switchover loop. If the value of the variable CC calculated in the previous flow processing is "0", it is judged as "1" this time. Then, the CPU 39 judges whether the value of the variable CC is "1" or not (step S405). If the CPU 39 judges that the value of the variable CC is "1", the CPU 39 selects G2 as the position at which the movement of the carriage 3 is started (refer to FIG. 10A); and in addition thereto, the CPU 39 selects A1 as the acceleration curve to be applied therefor and further selects A2 as the deceleration curve to be applied therefor (refer to FIG. 5B) (step S410). Accordingly, the CPU 39 transmits, to the motor driver 53, a signal for scanning the carriage 3 in accordance with the acceleration curve A1 from the movement start position G2 and scanning the carriage 3 in accordance with the deceleration curve A2 for its outward movement. Consequently, the carriage 3 travels in accordance with the velocity curve A1 during its acceleration from the movement start position G2 and in accordance with the velocity curve A2 during its deceleration in the outward movement thereof in the MS direction so as to perform printing (step S412). Subsequently, the value of BB, which indicates a global variable, is incremented by "1" (step S413). At the point in time at which the carriage 3 reaches its away position, the processing flow returns to the start of the switchover loop described herein. Then, next movement start position switchover processing/velocity data (deceleration curve) switchover processing is started. In addition thereto, the carriage 3 moves to its home position.

Next, if the results of judgment made both at the step S401 and the step S402 are YES again after returning to the start of this switchover loop, then, the value of the variable CC is calculated in the step S403. It should be noted that the value of the variable BB is incremented by "1" in the previous flow processing in this switchover loop. If the value of the variable CC calculated in the previous flow processing is "1", it is judged as "2" this time. Then, the CPU 39 judges whether the value of the variable CC is "2" or not (step S406). If the CPU 39 judges that the value of the variable CC is "2", the CPU 39 selects G3 as the position at which the movement of the carriage 3 is started (refer to FIG. 10A); and in addition thereto, the CPU 39 selects A1 as the acceleration curve to be applied therefor and further selects A3 as the deceleration curve to be applied therefor (refer to FIG. 5B) (step S411). Accordingly, the CPU 39 transmits, to the motor driver 53, a signal for scanning the carriage 3 in accordance with the acceleration curve A1 from the movement start position G3 and scanning the carriage 3 in accordance with the deceleration curve A3 for its outward movement. Consequently, the carriage 3 travels in accordance with the velocity curve A1 during its acceleration from the movement start position G3 and in accordance with the velocity curve A3 during its deceleration in the outward movement thereof in the MS direction so as to perform printing (step S412). Subsequently, the value of BB, which indicates a global variable, is incremented by "1" (step S413). At the point in time at which the carriage 3 reaches its away position, the processing flow returns to the start of the switchover loop described herein. Then, next movement start position switchover processing/velocity data (deceleration curve) switchover processing is started. In addition thereto, the carriage 3 moves to its home position.

Next, if the results of judgment made both at the step S401 and the step S402 are YES again after returning to the start of this switchover loop, then, the value of the variable CC is calculated in the step S403. It should be noted that the value of the variable BB is incremented by "1" in the previous flow processing in this switchover loop. If the value of the variable CC calculated in the previous flow processing is "2", it is judged as "3" this time. If the CPU 39 judges that the value of the variable CC is "3", the CPU 39 selects G4 as the position at which the movement of the carriage 3 is started (refer to FIG. 10A); and in addition thereto, the CPU 39 selects A1 as the acceleration curve to be applied therefor and further selects A4 as the deceleration curve to be applied therefor (refer to FIG. 5B) (step S407). Accordingly, the CPU 39 transmits, to the motor driver 53, a signal for scanning the carriage 3 in accordance with the acceleration curve A1 from the movement start position G4 and scanning the carriage 3 in accordance with the deceleration curve A4 for its outward movement. Consequently, the carriage 3 travels in accordance with the velocity curve A1 during its acceleration from the movement start position G4 and in accordance with the velocity curve A4 during its deceleration in the outward movement thereof in the MS direction so as to perform printing (step S412). Subsequently, the value of BB, which indicates a global variable, is incremented by "1" (step S413). At the point in time at which the carriage 3 reaches its away position, the processing flow returns to the start of the switchover loop described herein. Then, next movement start position switchover processing/velocity data (deceleration curve) switchover processing is started. In addition thereto, the carriage 3 moves to its home position.

As described above, if it is decided YES each in the steps S401 and S402 by the CPU 39 in this switchover loop, the movement positions for respective travels of the carriage 3 are switched over in such a manner that four times of reciprocating movements constitute one unit of operation. In addition, when the decisions made at the steps S401 and S402 are successive YES, the movement start positions and the deceleration curves are switched over among G1, G2, G3, and G4, and A1, A2, A3, and A4, respectively, in the order of appearance herein, in a sequential manner for respective travels (i.e., corresponding to the above-mentioned four times of reciprocating movements) in the unit of operation. The above series of operations is repeated until printing is completed. When the movement start positions and the deceleration curves are switched over sequentially in the order of G1, G2, G3, and G4, and A1, A2, A3, and A4, respectively, as described above, the vibrations of the carriage 3 occur at J1, J2, J3, and J4 during acceleration as illustrated in FIG. 10A and at D5, D6, D7, and D8 during deceleration as illustrated in FIG. 5B, that is, four different points in time each for acceleration and deceleration.

As described above, each of J1-J4 and D5-D8 is a point at which the carriage 3 is affected by vibration. Therefore, if the driving modes/movement start positions are switched over as described above, it is possible to shift (i.e., stagger) points in time at which the carriage 3 is affected by vibrations, that is, points in time at which unevenness in printing occurs. As a consequence thereof, in the same (or similar) manner as the first embodiment of the invention described above does, the present embodiment thereof offers advantageous effects in that the points J1-J4 and D5-D8 at which unevenness in printing could occur are staggered with respect to one another in the MS direction of the paper P after completion of printing. Therefore, uneven points will never be aligned along the SS direction. Thus, no rainbow unevenness appears on the paper P after completion of printing (refer to FIG. 7).

If the CPU 39 receives a signal that indicates that the paper size of the print target paper is "A3", driving modes are switched over for both acceleration and deceleration of the carriage 3 (refer to FIG. 12). Note that the printing operation based on such a switchover is the same as that of the counterpart illustrated in the first embodiment of the invention described above.

When scanning the carriage 3, the printer 80 having the configuration described above makes a decision to selectively use either the driving mode switchover or the movement start position switchover on the basis of paper size. With such a configuration, if there is a space that is sufficiently wide between the home position of the carriage 3 and the home-position-side end of the printing paper P, it is possible to perform a pattern switchover by switching the movement start positions of the carriage 3 at the home-position side. Therefore, in such a case, it is not necessary to achieve acceleration on the basis of a plurality of velocity curves for each printing path. As a result thereof, since it is not necessary to use a velocity curve having a relatively low degree of acceleration (i.e., low accelerated velocity), it is possible to offer high-speed printing. In addition, it is possible to shift (i.e., stagger) points in time at which the carriage 3 is affected by vibrations, that is, points in time at which unevenness in printing occurs because the driving modes/movement start positions are switched over as described above. As a consequence thereof, the points J1-J4 and the points D5-D8 at which unevenness in printing could occur are staggered with respect to one another in the MS direction of the printed paper P (i.e., the printing paper P after completion of printing). Therefore, uneven points will never be aligned along the SS direction on the printed paper P. Thus, the invention makes it possible to effectively avoid the generation of rainbow unevenness on the printing paper P after completion of printing.

According to the exemplary configuration of the printer 80 described above, the pattern switchover is carried out in accordance with printing direction, that is, either bidirectional printing or unidirectional printing, as well as printing resolution. Specifically, the movement start position pattern switchover/velocity data (deceleration curve) switchover is executed if high-resolution unidirectional printing is performed. Therefore, it is possible to adjust actual print quality, that is, printing precision, depending on required print quality. The pattern switchover is carried out either for each outward movement or for each set of outward and homeward movements of the carriage 3. Therefore, it is possible to apply the switchover (technique) of the scanning positions/scanning speeds of the carriage 3 according to the invention to both of bidirectional printing and unidirectional printing. Thus, the invention increases the diversification of printing that is performed by the printer according to embodiment thereof.

According to the exemplary configuration of the printer 80 described above, printing is started during acceleration of the carriage 3. After the start of printing, it is continued until the carriage 3 decelerates. Therefore, the invention makes it possible to provide a marginless printing, that is, printing with no margin left at edges of the printing paper P, or printing with relatively narrow margins left thereat. Thus, the invention makes it possible to offer high-quality printing.

Fourth Embodiment

With reference to accompanying drawings, a printing apparatus 90 according to a fourth exemplary embodiment of the invention is described below. It should be noted that, in the following description of the printer 90 according to the fourth exemplary embodiment of the invention, the same reference numerals are consistently used for the same components as those of the printer 1 according to the first exemplary embodiment of the invention so as to omit any redundant explanation or simplify explanation thereof.

Figure 14:
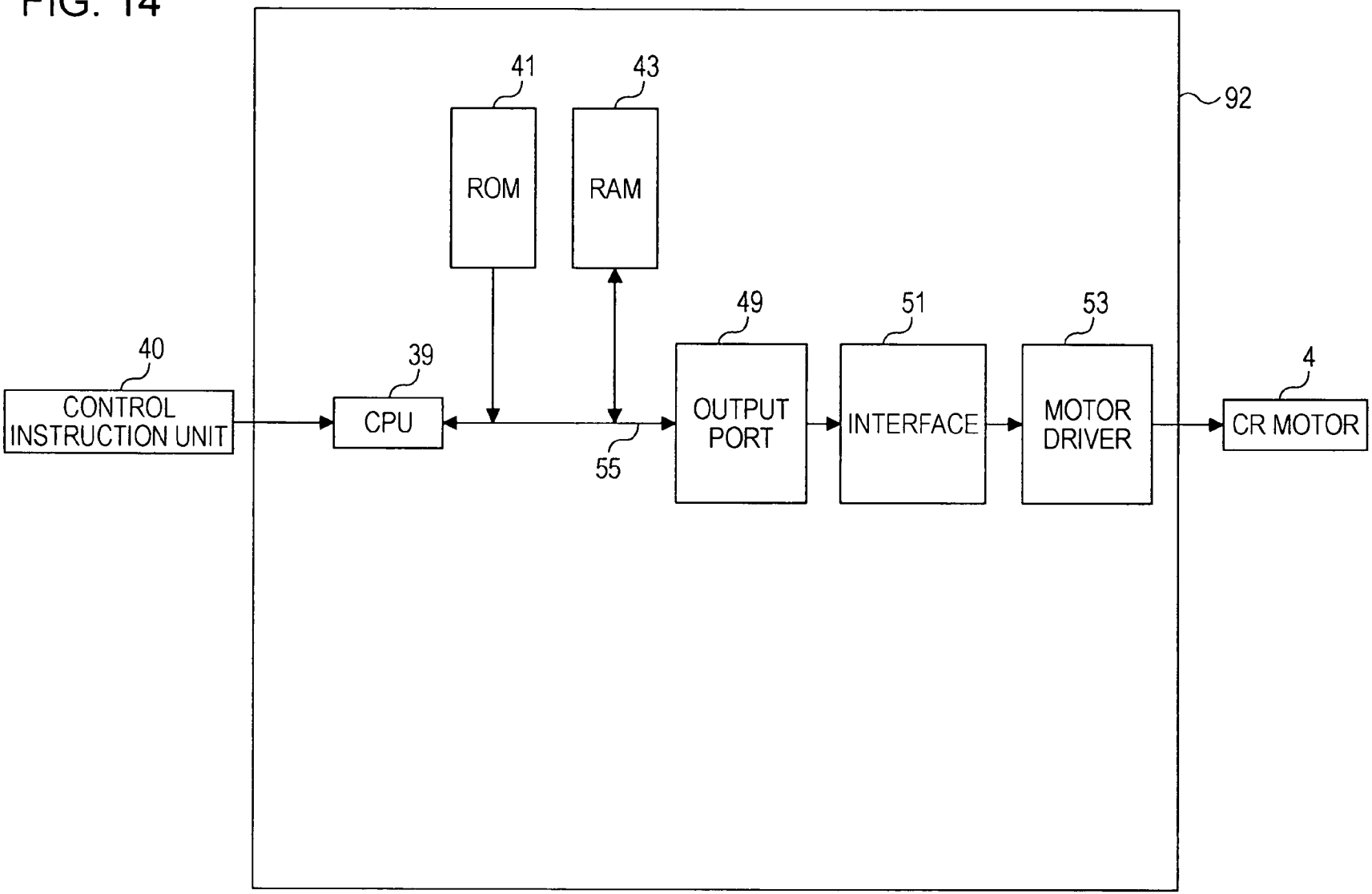
FIG. 14 is a block diagram that schematically illustrates an example of the configuration of a control unit according to the fourth exemplary embodiment of the invention.

FIG. 14 is a block diagram that schematically illustrates an example of the configuration of a control unit 92, which controls the CR motor 4 in the printer 90.

Note that the configuration of the printer 90 is the same as that of the counterpart illustrated in the first embodiment of the invention described above. In the configuration of the printer 90, the control unit 92, which functions as a control section, is in charge of controlling the driving speed of the CR motor 4. As illustrated in FIG. 14, the control unit 92 is provided with the CPU 39, the ROM 41, the RAM 43, the output port 49, the interface 51, and the motor driver 53. These components are interconnected with one another via the bus 55, which is a group of signal lines. In the present embodiment of the invention, the ROM 41 memorizes data of a velocity curve 5 in addition to that of the velocity curve A1. The velocity curve 5 is characteristic in that it does not reach the scanning speed at which the printer 90 vibrates in resonance therewith, that is, 22 ips according to this specification. The CPU 39, which functions as a velocity mode switchover section, switches over to a velocity data pattern in accordance with the velocity curve A5 stored in the ROM 41.

In the following description, a printing operation that is performed when the CPU 39 effects the switchover described above is explained.

Figure 15:
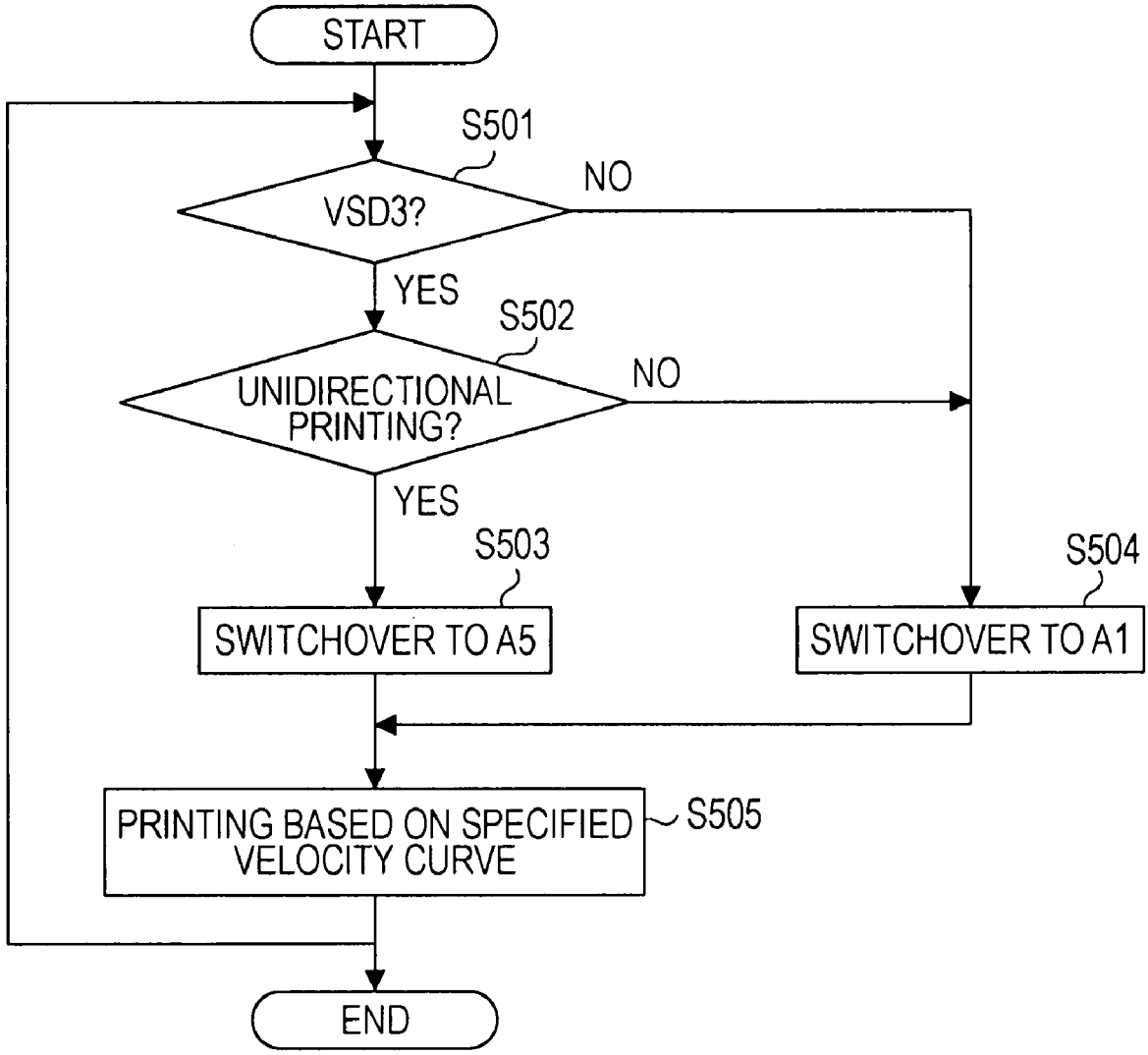
FIG. 15 is a flowchart that illustrates the operational flow of switchover processing performed by a velocity mode switchover section.
Figure 16A:
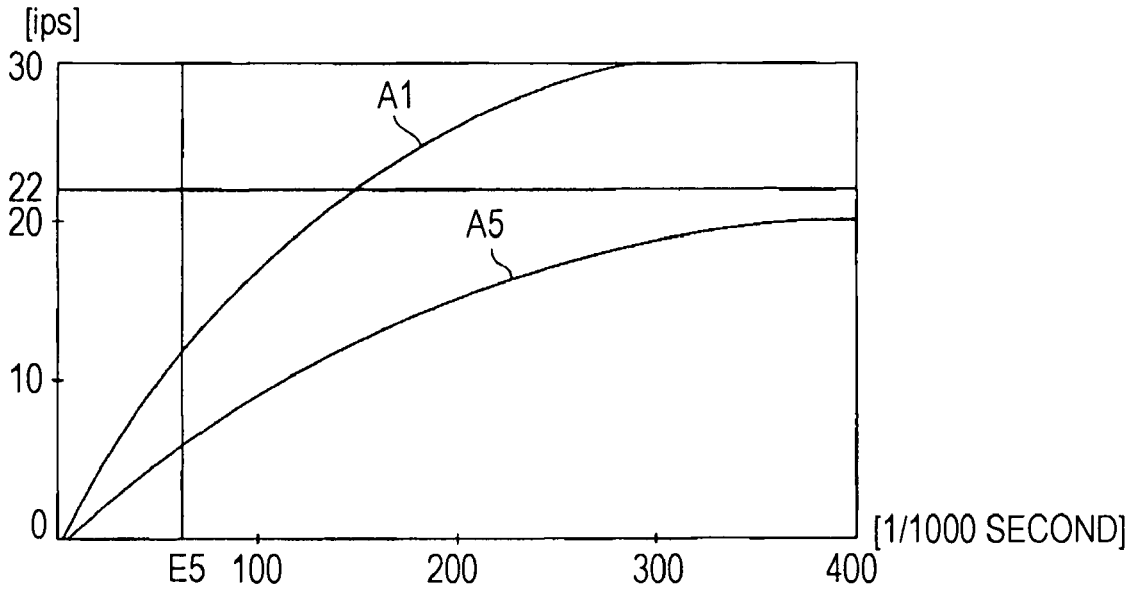
FIG. 16 is a set of diagrams that illustrates the scanning speeds of a carriage under velocity (i.e., reduced speed) mode.
Figure 16B:
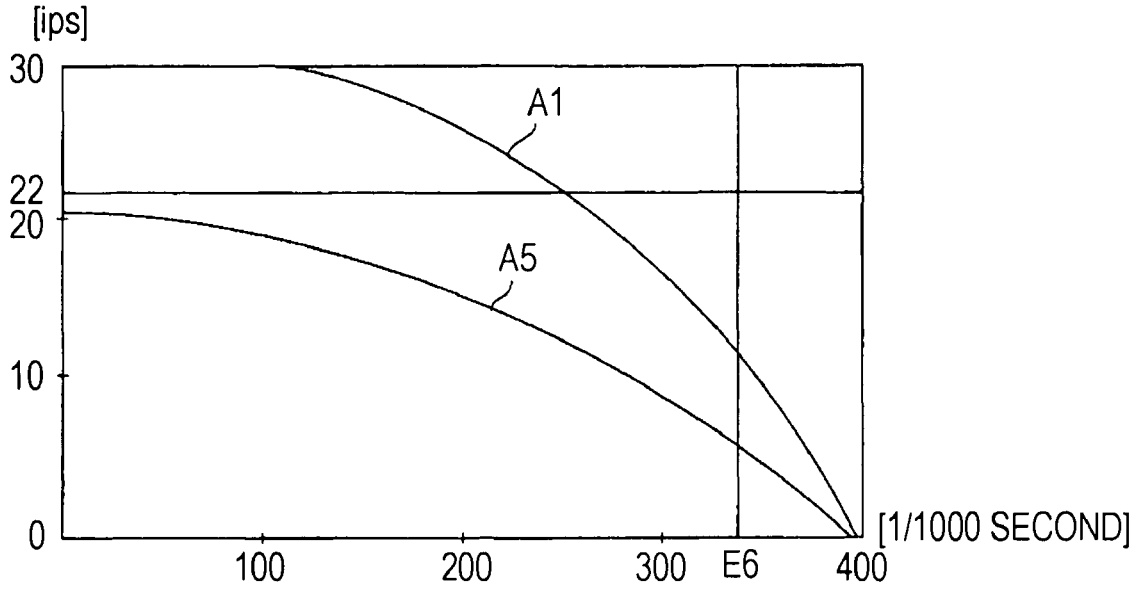

FIG. 15 is a flowchart that illustrates the operational flow of the switchover processing performed by the CPU 39 according to the present embodiment of the invention. FIG. 16 is a set of diagrams that illustrates velocity curves in the scanning of the carriage 3. Specifically, FIG. 16A illustrates the velocity curves (i.e., acceleration curves) that apply during acceleration of the carriage 3. On the other hand, FIG. 16B illustrates the velocity curves (i.e., deceleration curves) that apply during deceleration thereof. In each of FIGS. 16A and 16B, the horizontal axis represents time where the driving start of the carriage 3 is taken as zero. The vertical axis in each of FIGS. 16A and 16B represents the scanning speed of the carriage 3.

When printing is performed, as the first step, the control instruction unit 40 receives print-related data such as paper size, paper type, resolution, printing mode, unidirectional printing or bidirectional printing, color adjustment, and so on. Next, the control instruction unit 40 supplies the received data to the CPU 39. On the basis of the input data that is supplied from the control instruction unit 40, the CPU 39 reads out the velocity data stored in the ROM 41 or the RAM 43. Next, the CPU 30 performs arithmetic processing in accordance with the program. In the present embodiment of the invention, it is assumed that printing is performed under a MicroWeave printing mode.

In the present embodiment of the invention, it is assumed that so-called unidirectional printing is performed. As has already been described, in the unidirectional printing, ink drops are discharged from the print head 2 onto the printing paper P during a time period in which the carriage 3 travels along the MS direction from the home position to the away position thereof, which is referred to as outward movement and defined as the opposite word of homeward movement in this specification. The discharging of ink drops starts at the point in time E5 shown in FIG. 16A, and ends at the point in time E6 shown in FIG. 16B. This means that the print target area, at which printing is performed, is defined as a region where the carriage 3 travels during a time period between the point in time E5 and the point in time E6. The CPU 39 performs computation for the switchover according to the present embodiment of the invention when the carriage 3 reaches the away position after traveling along the MS direction.

When the CPU 39 receives various kinds of signals, it performs the velocity mode switchover so that printing is performed in the selected velocity mode. As illustrated in FIG. 15, as the first step of the velocity mode switchover shown in the flowchart thereof, the CPU 39 judges whether the dot size version is "VSD3" or not (step S501). If the dot size version is not "VSD3", that is, if the decision made at the step S501 is NO, the CPU 39 reads, out of the ROM 41, velocity data that corresponds to the velocity curve A1, and effects a switchover so as to select the velocity data corresponding to the velocity curve A1 (step S504). Next, the CPU 39 transmits a signal for scanning the carriage 3 in accordance with the velocity curve A1 to the motor driver 53. Accordingly, the carriage 3 reciprocates in the MS direction on the basis of the velocity curve A1. That is, the carriage 3 travels at the scanning speed based on the velocity curve A1 during both of its outward movement and homeward movement. During the outward movement, the carriage 3 performs printing (step S505). Thereafter, at the point in time at which the carriage 3 reaches its away position, the processing flow returns to the start of the switchover loop described herein. Then, next velocity data switchover processing is started. In addition thereto, the carriage 3 moves to its home position.

It is assumed that the result of judgment made at the step S501 is, again, NO after returning to the start of this switchover loop. If so, the velocity curve A1 is selected (step S504). Accordingly, the carriage 3 travels at the scanning speed based on the velocity curve A1 during both of its outward movement and homeward movement, while performing printing during its outward movement (step S505). As described above, if decisions made at the step S501 continue to be NO, in other words, if the dot size version is not "VSD3", printing continues to be performed on the basis of the same velocity curve (that is, velocity curve A1).

If it is judged as YES in the step S501, the CPU 39 further judges whether to perform so-called unidirectional printing or not, that is, whether to discharge ink during the outward movement of the carriage 3 only or not (step S502). If it is judged as NO in the step S502, the velocity data corresponding to the velocity curve A1 is read out; and the driving modes are switched over to select the velocity data corresponding to the velocity curve A1 (step S504). Then, a signal for scanning the carriage 3 in accordance with the velocity curve A1 is transmitted to the motor driver 53. Accordingly, the carriage 3 reciprocates in the MS direction on the basis of the velocity curve A1. The carriage 3 travels at the scanning speed based on the velocity curve A1 during both of its outward movement and homeward movement. Herein, since the decision made at the step S502 is NO, the carriage 3 performs so-called bidirectional printing; that is, the carriage 3 discharges ink both during the outward movement and the homeward movement thereof (step S505). At the point in time at which the carriage 3 reaches its away position, the processing flow returns to the start of the switchover loop described herein. Then, next velocity data switchover processing is started. In addition thereto, the carriage 3 moves to its home position.

If the decision made at the step S502 is YES, the CPU 39 reads, out of the ROM 41, velocity data that corresponds to the velocity curve A5 shown in the FIGS. 16A and 16B, and effects a switchover so as to select the velocity data corresponding to the velocity curve A5 (step S503). Then, the CPU 39 transmits a signal for scanning the carriage 3 in accordance with the velocity curve A5 to the motor driver 53. Accordingly, the carriage 3 performs printing at the scanning speed based on the velocity curve A5 during its outward movement (step S505). At the point in time at which the carriage 3 reaches its away position, the processing flow returns to the start of the switchover loop described herein. Then, next velocity data switchover processing is started. In addition thereto, the carriage 3 moves to its home position.

If it is decided YES successively in the steps S501 and S502 in a repetitive manner in this switchover loop, the carriage 3 is repeatedly scanned at the scanning speed that is in accordance with the velocity curve A5. If the carriage 3 is repeatedly scanned at the scanning speed that is in accordance with the velocity curve A5, the traveling speed of the carriage 3 will be lower than a speed at which the printer 90 vibrates in resonance therewith, that is, 22 ips according to this specification. This means that the carriage 3 never vibrates during printing. Thus, no rainbow unevenness appears on the paper P after completion of printing.

According to the configuration of the printer 90 described above, it is possible to control the carriage 3 so that it travels at the scanning speed that is lower than the speed at which the printer 90 vibrates in resonance therewith. Therefore, it is possible to prevent the carriage 3 from vibrating intensely due to the resonance vibration of the printer 90. Thus, it is possible to effectively prevent a decrease in printing precision (i.e., degradation in print quality) due to vibrations of the carriage 3 during printing. As a result thereof, it is possible to prevent the occurrence of rainbow unevenness on the paper P after completion of printing.

In addition, since the velocity data corresponding to the velocity curve A5 is stored in the ROM 41 of the printer 90, the invention makes it possible to read the velocity data corresponding to the velocity curve A5 out of the ROM 41 and to control the scanning speed of the carriage 3 on the basis of the read velocity data corresponding to the velocity curve A5. Therefore, it becomes easier to scan the carriage 3 with the same velocity pattern in a repetitive manner.

According to the exemplary configuration of the printer 90 described above, the pattern switchover is carried out in accordance with printing direction, that is, either bidirectional printing or unidirectional printing, as well as printing resolution. Specifically, the velocity data pattern switchover is executed if high-resolution unidirectional printing is performed. Therefore, it is possible to adjust actual print quality, that is, printing precision, depending on required print quality. The pattern switchover is carried out either for each outward movement or for each set of outward and homeward movements of the carriage 3. Therefore, it is possible to apply the switchover (technique) of the scanning speeds of the carriage 3 according to the invention to both of bidirectional printing and unidirectional printing. Thus, the invention increases the diversification of printing that is performed by the printer 90.

According to the exemplary configuration of the printer 90 described above, printing is started during acceleration of the carriage 3. After the start of printing, it is continued until the carriage 3 decelerates. Therefore, the invention makes it possible to provide a marginless printing, that is, printing with no margin left at edges of the printing paper P, or printing with relatively narrow margins left thereat. Thus, the invention makes it possible to offer high-quality printing.

Although various exemplary embodiments of the present invention are described above, needless to say, the invention is in no case restricted to these exemplary embodiments described herein; the invention may be configured and/or implemented in an adaptable manner in a variety of variations without departing from the spirit thereof.

In the first, second, and third exemplary embodiments of the invention described above, the velocity data corresponding to four velocity curves A1-A4 are stored in the ROM 41. However, the number of velocity curves, and thus the number of velocity data, is not limited to four. As an alternative configuration of the invention, the number of the velocity curves and thus the number of velocity data that are stored in the ROM 41 may be five or greater, or three or less.

Although the CPU 39, which functions as the driving mode switchover section, performs switchover by means of the velocity data corresponding to four velocity curves A1-A4 according to the first exemplary embodiment of the invention described above, it may be alternatively configured that the CPU 39 performs the switchover by means of the velocity data corresponding to three velocity curves or less. On the other hand, if the ROM 41 memorizes five pieces of velocity data corresponding to five velocity curves or greater, it may be alternatively configured that the CPU 39 performs the switchover by means of the above-mentioned five pieces of velocity data corresponding to five velocity curves or greater.

Similarly, although the CPU 39, which functions as the movement position switchover section, performs switchover by means of the movement start positions G1-G4 according to the second exemplary embodiment of the invention described above, the number of the movement start positions according to the invention is in no case limited to four. That is, it may be alternatively configured that the CPU 39 performs the switchover by means of five movement start positions or greater, or three movement start positions or less. In addition, the invention may be modified in such a manner that the movement stop positions are switched over so that they correspond to the movement start positions G1-G4. Moreover, the invention may be modified in such a manner that, when the movement stop positions are switched over, the number of the movement stop positions is not the same as that of the movement start positions.

The CPU 39, which functions as the movement position switchover section, uses the velocity curve A1 according to the second and third exemplary embodiments of the invention described above. However, the invention is in no case limited to such a configuration. That is, it may be alternatively configured that the CPU 39 uses either the velocity curve A2 or the velocity curve A3.

The CPU 39, which serves as the print target medium recognition section, recognizes (i.e., detects) the size of the print target paper according to the third exemplary embodiment of the invention described above. Then, on the basis of the recognition result, the CPU 39, which further serves as the switchover judgment section, makes a decision as to which one of the switchover methods should be used, that is, either the driving mode switchover or the movement start position switchover. However, the invention is in no case limited to such a configuration. For example, the invention may be modified in such a manner that the print target medium recognition section recognizes the paper type of the print target paper (for example, whether it is a "normal plain paper" or a "special glossy paper"). As another alternative example, it may be modified in such a manner that the print target medium recognition section recognizes the color type of the print target paper (for example, whether it is a "monochrome paper" or a "sepia-toned paper"). As still another alternative example, it may be modified in such a manner that the print target medium recognition section recognizes which one of the "edged printing" and "edgeless printing" is demanded. In the foregoing exemplary embodiment of the invention, the CPU 39, the switchover judgment section, makes a decision as to which one of the switchover methods should be used, that is, either the driving mode switchover or the movement start position switchover. However, the invention is in no case limited to such a configuration. For example, the invention may be modified in such a manner that the CPU 39 functioning as the switchover judgment section makes a decision so as to selectively use the velocity curves, the movement start positions, or the movement stop positions for effecting a switchover.

According to the fourth exemplary embodiment of the invention described above, the CPU 39, which functions as the velocity mode switchover section, uses only the velocity curve A5 if both of the decisions made at the steps S501 and S502 are YES. However, the invention is in no case limited to such a configuration. That is, it may be alternatively configured that the velocity curve A5 is used in combination with any one or more of the velocity curves A1-A4. In addition to the velocity data corresponding to the velocity curve A5 described in the fourth exemplary embodiment of the invention described above, another velocity data which corresponds to another velocity curve having a steady-state velocity that is less than 22 ips may be stored in the ROM 41. In such an alternative configuration, the above-mentioned another velocity curve having a steady-state velocity that is less than 22 ips may be used in place of the velocity curve A5, or it may be used in combination thereof.

In each of the foregoing exemplary embodiments of the invention, in a case where the dot size version is not "VSD3", the switchover section causes the carriage 3 to travel at the scanning speed based on the velocity curve A1 during both of its outward movement and homeward movement. However, the invention is in no case limited to such a configuration. For example, the invention may be modified in such a manner that the carriage 3 is scanned at the scanning speed in accordance with the velocity curve A1 during its outward movement only, whereas it is scanned during its homeward movement at another scanning speed in accordance with any one of the velocity curves A2-A4 or any other alternative curve that is not A1. Although it is assumed that unidirectional printing is performed if the dot size version is not "VSD3" in the foregoing exemplary embodiments of the invention, the invention may be modified so that bidirectional printing is performed in such a case in place of the unidirectional printing.

In the exemplary embodiments of the invention described above, the control instruction unit 40 receives input information on paper size and paper type. Herein, information on paper size and paper type may be obtained as user-input data, or alternatively, may be obtained through optical detection by means of a sensor.

According to the third exemplary embodiment of the invention described above, if the paper size is judged as "A4", the movement position switchover section performs a pattern switchover for acceleration of the carriage 3, whereas the driving mode switchover section performs a pattern switchover for deceleration thereof. However, the invention may be modified in such a manner that, if the size of the print target paper is judged as "A4", the driving mode switchover section performs a pattern switchover for both of acceleration and deceleration of the carriage 3. According to the third exemplary embodiment of the invention described above, if it is judged that the paper size is not "B5", "A4", nor "A3", the driving mode switchover section performs a pattern switchover for both of acceleration and deceleration of the carriage 3. However, the invention is not restricted to such a configuration. For example, the invention may be modified in such a manner that the movement position switchover section performs a pattern switchover for acceleration of the carriage 3, whereas the driving mode switchover section performs a pattern switchover for deceleration thereof for any paper size that is not "B5", "A4", nor "A3". Alternatively, if it is judged that the paper size is not "B5", "A4", nor "A3", a decision may be made so as to make selection between the driving mode switchover and the movement position switchover depending on the paper size thereof.

According to the first, second, and fourth exemplary embodiments of the invention described above, the print target medium recognition section is not provided. However, the invention described in these exemplary embodiments may be modified so that the velocity curve pattern switchover and either one or both of the movement start position switchover and the movement stop position switchover are performed on the basis of the detection result of the print target medium recognition section.

In each of the exemplary embodiments of the invention described above, the ROM 41 memorizes velocity data regarding the driving speed of the CR motor 4, which corresponds to the scanning speed of the carriage 3. However, the invention is in no case limited to such a configuration. For example, it may be modified in such a manner that velocity data of the scanning speed of the carriage 3 may be stored in the ROM 41. As another example, the velocity data regarding the driving speed of the CR motor 4 that corresponds to the scanning speed of the carriage 3 may be stored in the ROM 41 in addition to the velocity data of the scanning speed of the carriage 3.

In each of the exemplary embodiments of the invention described above, the carriage 3 is configured to accommodate the ink cartridges 21. However, the invention is in no case limited to such a configuration. As an example of alternative configurations, the ink cartridges 21 may be mounted not on the carriage 3 but on or in the body chassis of the printer 1, 70, 80, or 90. In such an alternative configuration, ink contained therein is fed to the print head 2 provided on the carriage 3 via, for example, ink tubes.

What is claimed is:

1. A printing apparatus that performs printing by scanning a carriage that has a print head in a main scan direction, the printing apparatus comprising:

a carriage motor that drives the carriage;

a control section that controls the carriage motor;

a memory section that stores a plurality of velocity patterns regarding at least one of scanning speeds of the carriage and driving speeds of the carriage motor corresponding to scanning speeds of the carriage; and a driving mode switchover section that supplies a selected velocity pattern by switching over the plurality of velocity patterns in a sequential manner, wherein the control section controls the carriage motor such that the carriage is scanned on the basis of the selected velocity pattern.

2. The printing apparatus according to claim 1, wherein the plurality of velocity patterns are provided for at least one of acceleration of the carriage that is to be scanned and deceleration of the carriage that is to be scanned.

3. The printing apparatus according to claim 1, wherein the driving mode switchover section switches the selected velocity patterns either once for each outward movement of the carriage or once for each outward movement of the carriage and once for each homeward movements of the carriage.

4. The printing apparatus according to claim 1, further comprising a print target medium recognition section that detects the size or the type of a print target medium, wherein the driving mode switchover section switches the selected velocity pattern on the basis of a detection that is performed by the print target medium recognition section.

5. The printing apparatus according to claim 1, wherein the driving mode switchover section switches the selected velocity pattern on the basis of ink discharge amount.

6. The printing apparatus according to claim 1, wherein printing is started during acceleration of the carriage, or printing that has started is continued until the carriage decelerates.

* * * * *